US008646872B2

(12) United States Patent
Jo

(10) Patent No.: US 8,646,872 B2
(45) Date of Patent: Feb. 11, 2014

(54) INKJET RECORDING APPARATUS INCLUDING INK RECEIVING ASSEMBLY

(71) Applicant: Honriku Jo, Kanagawa (JP)

(72) Inventor: Honriku Jo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/654,597

(22) Filed: Oct. 18, 2012

(65) Prior Publication Data

US 2013/0120508 A1 May 16, 2013

(30) Foreign Application Priority Data

Nov. 15, 2011 (JP) ..... 2011-249481

(51) Int. Cl.
*B41J 2/165* (2006.01)

(52) U.S. Cl.
USPC ..... 347/35

(58) Field of Classification Search
USPC ..... 347/29, 30, 32, 33–36, 90
See application file for complete search history.

(56) References Cited

U.S. PATENT DOCUMENTS

| | | | | |
|---|---|---|---|---|
| 6,619,783 | B2 * | 9/2003 | Kanaya et al. | 347/35 |
| 6,827,422 | B2 * | 12/2004 | Horie | 347/29 |
| 7,044,579 | B2 * | 5/2006 | Katsuumi | 347/30 |
| 7,950,785 | B2 * | 5/2011 | Usuda et al. | 347/85 |
| 8,087,746 | B2 * | 1/2012 | Ray | 347/35 |
| 2012/0056932 | A1 | 3/2012 | Matsubara et al. | |
| 2012/0133707 | A1 | 5/2012 | Kikkawa et al. | |
| 2012/0162315 | A1 | 6/2012 | Takano et al. | |

FOREIGN PATENT DOCUMENTS

| | | |
|---|---|---|
| JP | 2000-153621 | 6/2000 |
| JP | 2001-162836 | 6/2001 |
| JP | 2003-25610 | 1/2003 |
| JP | 2007-296835 | 11/2007 |
| JP | 2009-220365 | 10/2009 |
| JP | 2011-126062 | 6/2011 |
| JP | 2012-139829 | 7/2012 |

OTHER PUBLICATIONS

U.S. Appl. No. 13/493,050, filed Jun. 11, 2012, Tomomi Katoh, et al.

* cited by examiner

*Primary Examiner* — Anh T. N. Vo
(74) *Attorney, Agent, or Firm* — Cooper & Dunham LLP

(57) ABSTRACT

An inkjet recording apparatus includes an inkjet head to horizontally eject ink droplets to print on a recording medium and an ink receiving assembly to receive ink droplets ejected for dummy ejection from the inkjet head. The ink receiving assembly includes a non-porous ink receiving plate and a collection tank. The ink receiving plate has a hydrophilic receiving face broader than an ejection range of the ink droplets ejected for dummy ejection. The receiving face is substantially vertically disposed to receive the ink droplets ejected for dummy ejection. The collection tank is disposed below the ink receiving plate to collect ink droplets received by and dropped from the ink receiving plate. Ad/stance between the inkjet head and the receiving face of the ink receiving plate is set to be shorter than a distance in which the ink droplets ejected from the inkjet head for dummy ejection turn into mist.

17 Claims, 18 Drawing Sheets

RERATED ART

INKJET RECORDING APPARATUS INCLUDING INK RECEIVING ASSEMBLY

CROSS-REFERENCE TO RELATED APPLICATION

This patent application is based on and claims priority pursuant to 35 U.S.C. §119 to Japanese Patent Application No. 2011-249481, filed on Nov. 15, 2011 in the Japan Patent Office, the entire disclosure of which is hereby incorporated by reference herein.

BACKGROUND

1. Technical Field

This disclosure relates to an inkjet recording apparatus, and more specifically to an inkjet recording apparatus used as, for example, a copier, a printer, a facsimile machine, or a multi-functional device having two or more of the foregoing capabilities.

2. Description of the Related Art

Conventionally, non-impact recording methods are known to be advantageous in that noise is negligibly small during recording. Of the non-impact recording methods, in particular, inkjet recording methods are quite useful because they allows high-speed printing without any special fixing process on a plain sheet of paper. Recently, in the field of the inkjet recording method, a large number of color recording methods using color inks have been proposed and improved.

As one of such inkjet recording methods, an inkjet recording method is proposed to fly ink droplets of different colors and attach the droplets on a recording medium for recording. An inkjet recording apparatus employing the inkjet recording method has an inkjet head above the recording medium horizontally conveyed to eject ink droplets toward just below the inkjet head and a carriage to reciprocally move the inkjet head in a width direction relative to the recording medium.

The inkjet recording apparatus also has an ink receiving assembly at an external area in a width direction of a printing area at which printing is performed on the recording medium, that is, outside the printing area. The ink receiving assembly has a porous sheet horizontally disposed opposing nozzles of the inkjet head and a collection tank disposed below the porous sheet.

During activation of the inkjet recording apparatus, ink droplets for dummy ejection not contributing to recording are regularly ejected from the nozzles to the ink receiving assembly to prevent ejection failure caused by an increase in the viscosity of ink adhering on nozzles during non use. As the dummy ejection, for example, ink droplets may be ejected a few tens of times per nozzle every a few seconds. The dummy ejection may be performed at the start of printing or after cleaning operation to prevent different color inks to mix each other.

The dummy ejection allows removal of viscosity-increased ink adhering on nozzles, thus preventing such viscosity-increased ink from drying and clogging the nozzles. For the above-described ink receiving assembly, since ink droplets are ejected vertically downward, i.e., the same direction as the gravitational direction, the ink droplets land on the porous sheet while maintaining a high speed, thus preventing the ink droplets from turning into mist.

By contrast, inkjet recording apparatuses are becoming widely used that vertically convey recording media and have an inkjet head to eject ink horizontally, not vertically downward, from nozzles. If such an inkjet recording apparatus employs an ink receiving assembly including a horizontal porous sheet as described above, the distance at which ink droplets for dummy ejection fly from when the ink droplets are horizontally ejected nozzles to when the ink droplets drop on the horizontal porous sheet is longer than that of the above-described configuration in which ink droplets are ejected vertically downward from nozzles. As a result, the ink droplets ejected from the nozzles may speed down, turn into ink mist, and spread around.

In other words, when ink droplets fly a long distance, the ink droplets suspend due to air resistance and turn into mist. Such ink mist spread around to the nozzle face of the inkjet head and is scattered inside the apparatus by internal turbulence caused by the reciprocal movement of the carriage. As a result, the inside of the inkjet recording apparatus may be contaminated with ink mist.

To deal with such a failure, ink droplets need to land on the ink receiving assembly before turning into mist Hence, for example, as illustrated in FIG. 1, an ink receiving assembly 102 is proposed in which a porous sheet 101 is vertically disposed opposing nozzles 100 (see, for example, JP-3707274-B1 (JP-2000-153621-A)).

The ink receiving assembly 102 has a case 105 and the porous sheet 101. The case 105 includes a first cylindrical body 103 and a second cylindrical body 104. The first cylindrical body 103 is connected to the second cylindrical body 104 so as to form an angle of 130 degrees relative to the second cylindrical body 104 at a middle portion of the case 105. The porous sheet 101 is rectangular and mounted on an opening portion 105*a* of the case 105. The periphery of the porous sheet 101 is surrounded by and fixed at the opening portion 105*a* of the case 105.

For the ink receiving assembly 102, ink droplets 106 horizontally ejected from the nozzles 100 for dummy ejection are absorbed into the porous sheet 101 and, as indicated by arrows in FIG. 1, flow downward inside the porous sheet 101 and drop from a lower end of the porous sheet 101. Furthermore, the dropped ink moves inside the case 105 and is collected to a collection tank.

In addition, for example, an ink receiving assembly is proposed that has a driving pulley, a driven pulley disposed at a position horizontal to the driving pulley, a belt horizontally looped around the driving pulley and the driven pulley, and a collection tank having an edge portion in contact with a lower side of the belt (see, for example, JP-2001-162836-A).

For the ink receiving assembly, ink droplets for dummy ejection are ejected vertically downward from an inkjet head and adhere on an upper face of the belt just below the inkjet head. When the ink droplets accumulate on the upper face of the belt, a driving roller is rotated to move the ink droplets with the belt. The ink droplets move around to the lower side of the belt, are scraped by the edge portion of the collection tank, and are collected into the collection tank.

However, for the ink receiving assembly 102 in which the porous sheet 101 is vertically disposed, ink droplets 106 ejected for dummy ejection are absorbed into the porous sheet 101. As a result, a portion of ink droplets 106 passes through the porous sheet 101 and turns into mist, thus contaminating the inside of the inkjet recording apparatus. In addition, since the porous sheet 101 is vertically disposed, a portion of the ink droplets 106 absorbed may remain at the lower end of the porous sheet 101 without dropping from the lower end, thus increasing the viscosity and hardening. As a result, hardened ink may reduce the effect of preventing occurrence of mist, reduce the absorbing performance of the porous sheet 101, and hamper smooth dropping from the lower end of the porous sheet 101.

For the ink receiving assembly having a belt horizontally disposed to receive ink droplets ejected for dummy ejection, ink droplets adhering on the belt are scraped by the edge portion of the collection tank disposed at the lower side of the belt. As a result, ink droplets ejected for dummy ejection and adhering on the belt are not scraped until the ink droplets moves to the lower side of the belt. As a result, ink may adhere on a wider area and drop from the edges of the belt, or ink may evaporate and firmly fix. In addition, when the belt of the ink receiving assembly is vertically disposed to apply the ink receiving assembly to an inkjet head that horizontally ejects ink droplets for dummy ejection, the above-described failure may arise.

BRIEF SUMMARY

In an aspect of this disclosure, there is provided an inkjet recording apparatus including an inkjet head and an ink receiving assembly. The inkjet head horizontally ejects ink droplets to print on a recording medium. The ink receiving assembly receives ink droplets ejected for dummy ejection from the inkjet head. The ink receiving assembly includes a non-porous ink receiving plate and a collection tank. The non-porous ink receiving plate has a hydrophilic receiving face broader than an ejection range of the ink droplets ejected for dummy ejection. The receiving face is substantially vertically disposed to receive the ink droplets ejected for dummy ejection. The collection tank is disposed below the ink receiving plate to collect ink droplets received by and dropped from the ink receiving plate. A distance between the inkjet head and the receiving face of the ink receiving plate is set to be shorter than a distance in which the ink droplets ejected from the inkjet head for dummy ejection turn into mist.

In another aspect of this disclosure, there is provided an inkjet recording apparatus including an inkjet head and an ink receiving assembly. The inkjet head horizontally ejects ink droplets to print on a recording medium. The ink receiving assembly receives ink droplets ejected for dummy ejection from the inkjet head outside a printing area of the inkjet head. The ink receiving assembly includes a porous ink receiving belt, a support device, a rotary device, a scraping device, and a collection tank. The porous ink receiving belt has a receiving face broader than an ejection range of the ink droplets ejected for dummy ejection. The receiving face is substantially vertically disposed opposing the inkjet head to receive the ink droplets ejected for dummy ejection and disposed away from the inkjet head in a distance shorter than a distance in which the ink droplets ejected from the inkjet head for dummy ejection turn into mist. The support device rotatably supports the ink receiving belt. The rotary device rotates the ink receiving belt toward a lower side of the receiving face. The scraping device is disposed below the receiving face to scrape ink droplets adhering on the receiving face with movement of the receiving face. The collection tank is disposed below the scraping device to collect ink scraped from the receiving face by the scraping device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
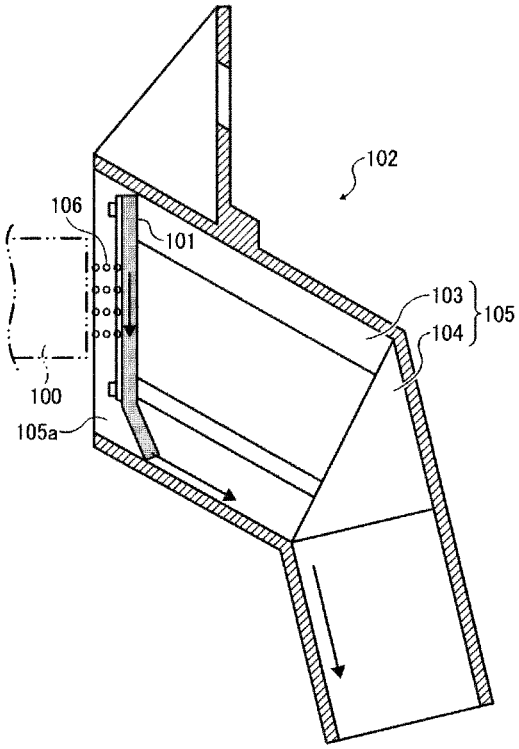
FIG. 1 is a vertical cross sectional view of an ink receiving assembly of a conventional type of inkjet recording apparatus.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First Exemplary Embodiment

First, an inkjet recording apparatus 1 according to a first exemplary embodiment of this disclosure is described with reference to FIG. 2.

The inkjet recording apparatus 1 includes an inkjet head 4, a carriage 5, a carriage moving device 7, an ink receiving assembly 8, a reliability maintenance device 10, and a recording-medium conveyance assembly 11. The inkjet head 4 horizontally ejects ink droplets 2 to print on a recording medium 3. The carriage 5 holds the inkjet head 4. The carriage moving device 7 moves the carriage 5 in a main scanning direction indicated by an arrow X in FIG. 2, that is, a width direction of the recording medium 3. The ink receiving assembly 8 is disposed at one end in the main scanning direction X of a non-printing area other than a printing area at which printing is performed on the recording medium 3, and receives ink droplets 2 ejected from the inkjet head 4 by dummy ejection in which ink droplets not contributing to recording are ejected to discharge, e.g., viscosity increased ink from nozzles. The reliability maintenance device 10 is disposed at the opposite end in the main scanning direction X of the non-printing area other than the printing area, and maintains and recovers conditions of nozzles 9 of the inkjet head 4. The recording-medium conveyance assembly 11 feeds and outputs the recording medium 3.

Figure 2:
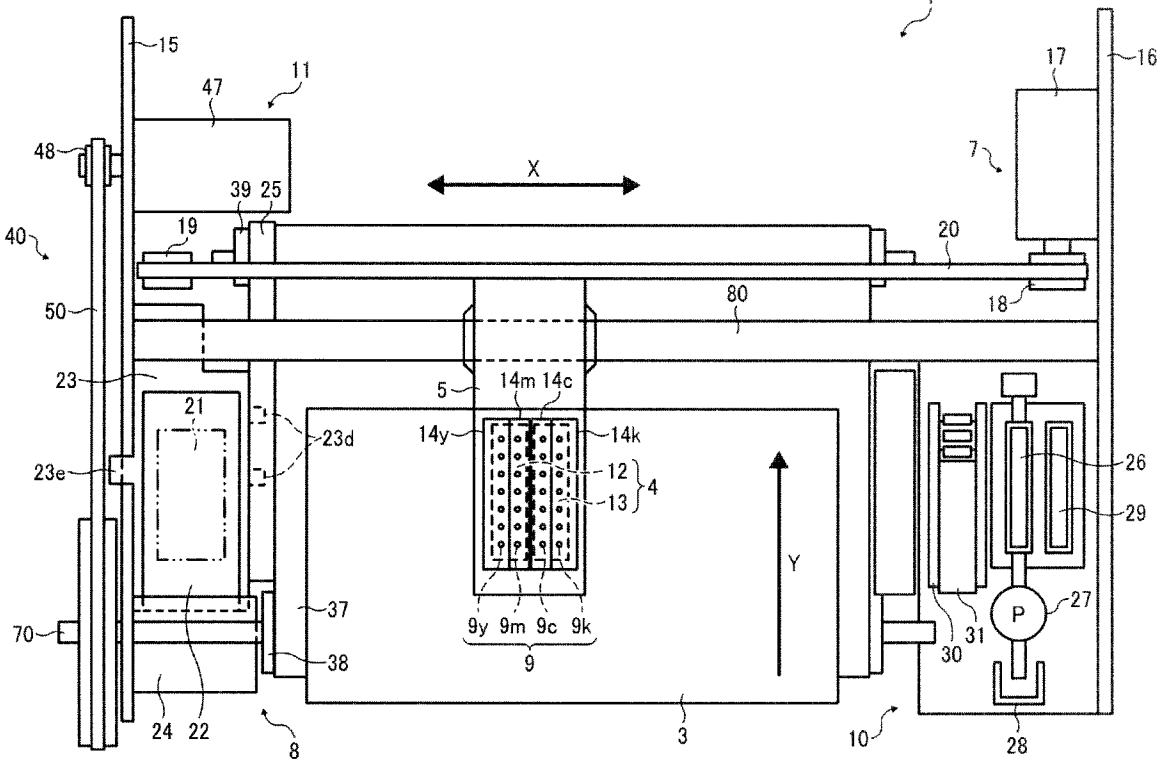
FIG. 2 is a schematic front view of an inkjet recording apparatus according to a first exemplary embodiment of this disclosure.

In this exemplary embodiment, as illustrated in FIG. 2, the main scanning direction X represents a crosswise (left-right) direction when the recording medium 3 is seen from the carriage 5 side. The recording medium 3 opposing the inkjet head 4 is conveyed in a direction from a lower side to an upper side in FIG. 2, that is, a sub-scanning direction indicated by an arrow Y in FIG. 2.

Figure 3:
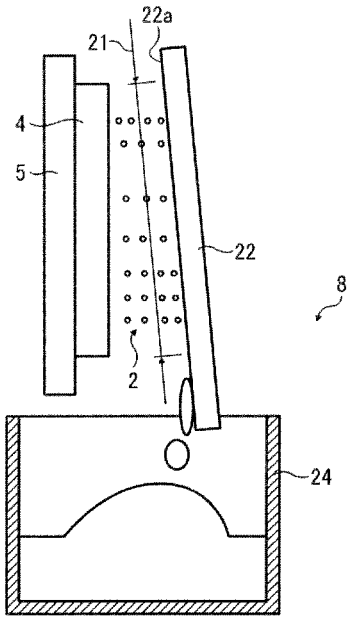
FIG. 3 is a schematic side view of an inkjet head and an ink receiving assembly of the inkjet recording apparatus according to the first exemplary embodiment.
Figure 4:
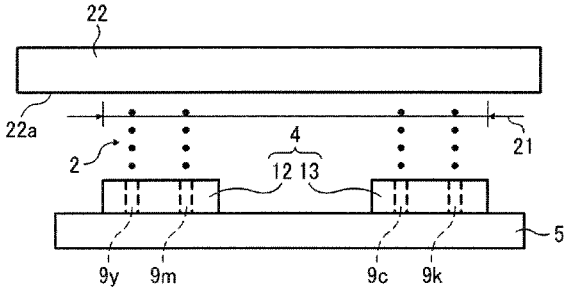
FIG. 4 is a schematic plan view of the inkjet head and the ink receiving assembly of the inkjet recording apparatus according to the first exemplary embodiment.

As illustrated in FIGS. 2 to 4, the inkjet head 4 includes a first head 12 and a second head 13 extending vertically. The first head 12 has nozzle rows 9*y* and 9*m*, and the second head 13 has nozzle rows 9*c* and 9*k*. In other words, the inkjet head 4 is mounted on the carriage 5 so that the nozzles 9 are oriented vertically relative to the carriage 5 and arranged in rows perpendicular to the main scanning direction X and ink droplets are horizontally ejected from the nozzles 9.

The first head 12 has the nozzle row 9*y* of multiple nozzles 9 to eject ink droplets 2 of yellow (Y) and the nozzle row 9*m* of multiple nozzles 9 to eject ink droplets 2 of magenta (M). The second head 13 has the nozzle row 9*c* of multiple nozzles 9 to eject ink droplets 2 of cyan (C) and the nozzle row 9*k* of multiple nozzles 9 to eject ink droplets 2 of black (Bk). In other words, the inkjet recording apparatus 1 can eject a plurality of different colors of inks.

As energy generators for generating energy to eject ink droplets 2, the inkjet head 4 may employ, for example, piezoelectric actuators such as piezoelectric elements, thermal actuators that generate film boiling of liquid (ink) using electro/thermal converting elements such as heat-generation resistants to cause phase change, shape-memory-alloy actuators that change metal phase by a temperature change, or electrostatic actuators that generate pressure by electrostatic force. In this exemplary embodiment, as the energy generators, the inkjet head 4 employs piezoelectric element serving as piezoelectric actuators.

The carriage 5 mounts ink containers 14*y*, 14*m*, 14*c*, and 14*k* to supply the respective color inks to the nozzle rows 9*y*, 9*m*, 9*c*, and 9*k* of the inkjet head 4. In other words, the carriage 5 mounts the ink container 14*y* to contain yellow (Y) ink, the ink container 14*m* to contain magenta (M) ink, the ink container 14*c* to contain cyan (C) ink, and the ink container 14*k* to contain black (Bk) ink.

The carriage moving device 7 includes guide rods 80 and 81, a main scanning motor 17 a driving pulley 18, a driven pulley 19, and an endless driving belt 20. The guide rods 80 and 81 extend between left and right side plates 15 and 16 to support the carriage 5 slidably in the main scanning direction X. The main scanning motor 17 is disposed at one side (right side in FIG. 2) in the main scanning direction X. The driving pulley 18 is mounted on the main scanning motor 17. The driven pulley 19 is disposed at the opposite side (left side in FIG. 2) in the main scanning direction X. The driving belt 20 extends between the driving pulley 18 and the driven pulley 19 and is fixed at the carriage 5.

When the main scanning motor 17 is driven, the driving belt 20 rotates to move the carriage 5 in the main scanning direction X along the guide rods 80 and 81. Ink droplets 2 are ejected from the nozzles 9 of the inkjet head 4 to print on a recording face of the recording medium 3. For monochromatic printing, only the second head 13 is driven to eject ink droplets 2 from the nozzle row 9*k*.

As illustrated in FIGS. 2 to 7, the ink receiving assembly 8 is disposed at a non-printing area at the left side in the main scanning direction X. The ink receiving assembly 8 has an ink receiving plate 22, a holder 23, and a collection tank 24. The ink receiving plate 22 is not porous and has a receiving face 22*a* broader than an ejection range 21 in which ink droplets 2 are ejected by dummy ejection. The receiving face 22*a* is hydrophilic and substantially vertically oriented. The ink droplets 2 land on the receiving face 22*a*. The holder 23 holds the ink receiving plate 22 with the ink receiving plate 22 supported by the left side plate 15. The collection tank 24 is disposed below the ink receiving plate 22 to collect ink droplets 2 landing on and dropped from the ink receiving plate 22.

To prevent some of the nozzles 9 not used in printing from clogging due to drying, the ink receiving assembly 8 removes viscosity-increased ink from the nozzles 9 by dummy ejection. As described above, since the receiving face 22*a* of the ink receiving plate 22 is hydrophilic, is substantially vertically oriented, and is broader than the ejection range 21 of ink droplets 2, ink droplets 2 ejected from the inkjet head 4 by dummy ejection are landed on the receiving face 22*a* of the ink receiving plate 22. Then, without being absorbed by the ink receiving plate 22 and residing at a lowest portion of the ink receiving plate 22, the ink droplets 2 drop from the ink receiving plate 22 and are collected in the collection tank 24.

Figure 6:
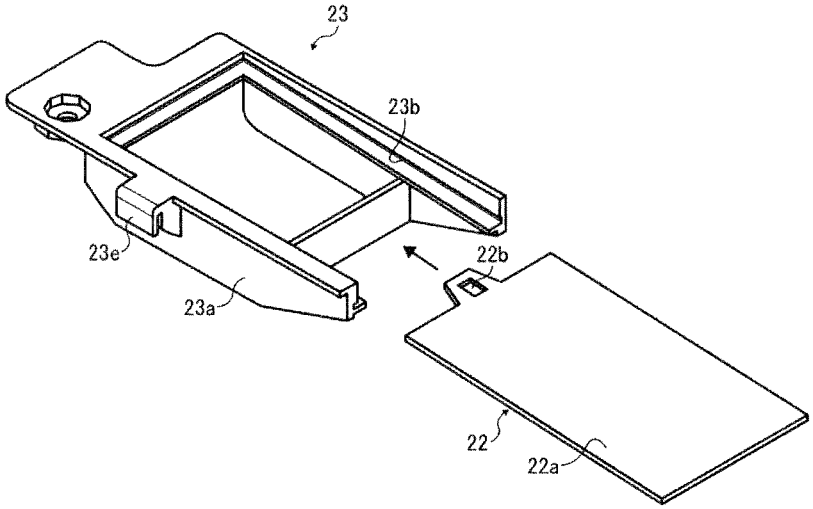
FIG. 6 is a schematic perspective view of a holder and an ink receiving plate of the inkjet recording apparatus according to the first exemplary embodiment in a state in which the ink receiving plate is removed from the holder.
Figure 7:
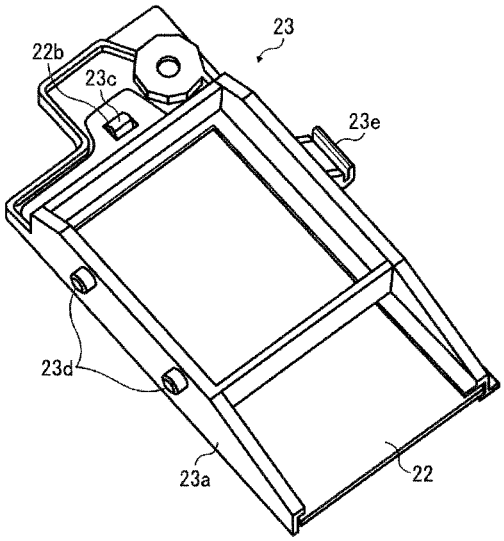
FIG. 7 is a schematic perspective view of the holder and the ink receiving plate of the inkjet recording apparatus according to the first exemplary embodiment in a state in which the ink receiving plate is mounted on the holder.

As illustrated in FIGS. 6 and 7, the holder 23 has a body 23*a*, a holding groove 23*b*, an engagement protrusion 23*c*, guide-member-side protrusions 23*d*, and a side-plate-side protrusion 23*e*. The body 23*a* is a substantially U-shaped frame. The holding groove 23*b* holds the ink receiving plate 22 so that the ink receiving plate 22 is removably mountable from an opening side of the substantially U-shape of the body 23*a* relative to the body 23*a*. When the ink receiving plate 22 is mounted on the body 23*a*, the engagement protrusion 23*c* engages, i.e., hooks on an engagement hole 22*b* of the ink receiving plate 22 to prevent dropping and removal of the ink receiving plate 22 from the body 23*a*. The guide-member-side protrusions 23*d* protrude outward from the body 23*a* to engage or fit a guide member 25 of the recording-medium conveyance assembly 11. The side-plate-side protrusion 23*e* protrudes outward from the body 23*a* to engage or hook on the left side plate 15. The body 23*a* has left and right side portions parallel to each other and a rear portion connecting one end of the left side portion and one end of the right side portion. The opposite end side of the left and right side portions is opened to form a frame shape. The ink receiving plate 22 is removably mountable relative to the body 23*a* from the opposite end side of the left and right side portions.

Here, as illustrated in FIG. 3, the holding groove 23*b* is a slanted face having an upper portion of the receiving face 22*a* of the ink receiving plate 22 at a side proximal to the inkjet head 4 and a lower portion of the receiving face 22*a* at a side distal to the inkjet head 4. Thus, ink droplets 2 landing on the receiving face 22*a* promptly flow downward and drop from the lowermost part of the receiving face 22*a*.

In addition, through experiments, the inventor of the present application finds that, when ink droplets having a diameter of 20 μm are horizontally ejected at a predetermined density, the ink droplets do not turn into mist within a range of 5 mm from ejection ports. Based on this finding, in this exemplary embodiment, the distance between the ink receiving plate 22 and the inkjet head 4 are set to be 3 mm at the uppermost portion of the ink receiving plate 22 and 5 mm at the lowermost portion of the ink receiving plate 22. As a result, since the clearance between the inkjet head 4 and the receiving face 22*a* is set to be 3 to 5 mm, ink droplets 2 land on the receiving face 22*a* before turning into mist, thus preventing occurrence of mist.

The ink receiving plate 22 is a flat plate, and the receiving face 22*a* is a flat face. The ink receiving plate 22 has the engagement hole 22*b* to engage or hook on the engagement protrusion 23*c* of the holder 23. The receiving face 22*a* of the ink receiving plate 22 is hydrophilic. In this exemplary embodiment, the ink receiving plate 22 is coated with titanium dioxide. The hydrophilic coating material is not limited to titanium dioxide but, for example, hydrophilic coating material of Teflon (registered trademark) resin or fiber glass (film) may be used.

The ink receiving plate 22 is also made of a material meeting desired properties in contact with ink. In this exemplary embodiment, the ink receiving plate 22 is made of a transparent material of PET (polyethylene terephthalate) resin. The material meeting desired properties in contact with ink is not limited to PET resin but may be, for example, a transparent material of acrylic (polymethyl methacrylate: PMMA). In addition, the material is not limited to transparent material but may be, for example, polyacetal resin (POM) or epoxy resin (PE). As a result, even when the ink receiving plate 22 contacts ink for a long period of time, the above-described configuration prevents chemical reactions of the ink receiving plate 22 with ink components.

The collection tank 24 is removably mountable relative to the left side plate 15. In other words, the collection tank 24 is movable, thus facilitating ink collection when the collection tank 24 is filled with ink.

The ink receiving assembly 8 is disposed at a side opposite to the reliability maintenance device 10 across the printing area. Such a configuration obviates the necessity for the carriage 5 to return to the reliability maintenance device 10 to perform preliminary ejection for recovering the ejection performance, thus preventing a reduction in printing speed.

As illustrated in FIG. 2, the reliability maintenance device 10 is disposed opposing a standby position of the carriage 5 in the non-printing area of the right side in the main scanning direction X. The reliability maintenance device 10 has a suction cap 26, a suction pump 27, a waste-liquid tank 28, a moisture-retention cap 29, a wiping blade 30, and an absorption member 31. The suction cap 26 sucks nozzles 9 of the inkjet head 4 from which ink droplets 2 are not normally ejected. The suction pump 27 is connected to the suction cap 26. The waste-liquid tank 28 collects ink having been sucked from the suction cap 26 by the suction pump 27. The moisture-retention cap 29 caps (covers) the nozzle faces to prevent drying of the nozzles 9. The wiping blade 30 wipes the nozzle faces to remove residual ink, paper dust, or other dust. The absorption member 31 is made of, e.g., nonwoven fabric to absorb ink removed by the wiping blade 30. When ink droplets 2 are not normally ejected from the inkjet head 4, the reliability maintenance device 10 activates the suction pump 27 to absorb ink from the nozzles 9 via the suction cap 26, thus recovering the performance of the inkjet head 4.

Figure 8:
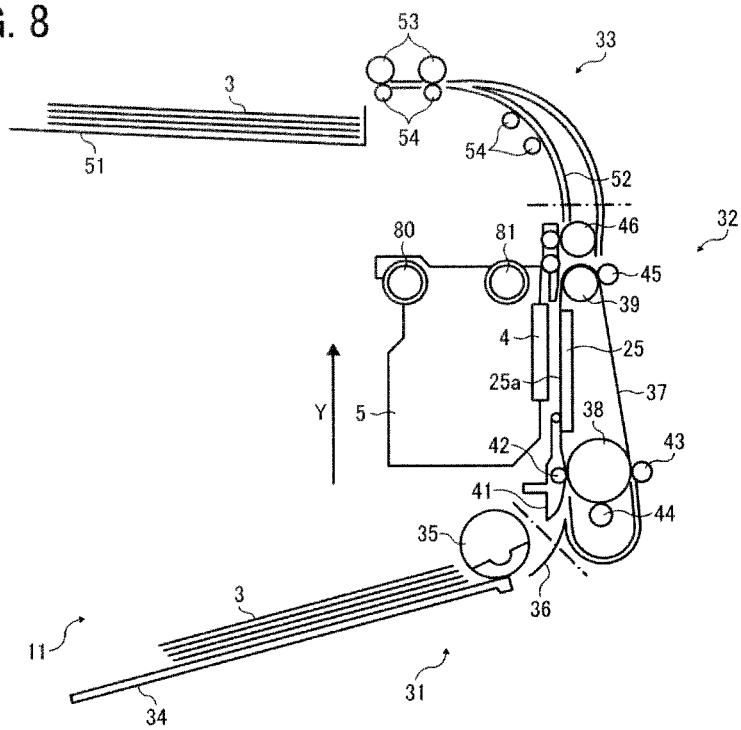
FIG. 8 is a schematic side view of a transport path of a recording medium in the inkjet recording apparatus according to the first exemplary embodiment.
Figure 9:
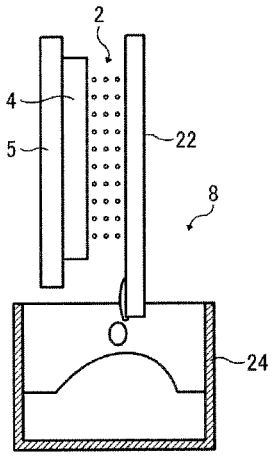
FIG. 9 is a schematic side view of another example of the inkjet head and the ink receiving assembly of the inkjet recording apparatus according to the first exemplary embodiment.

As illustrated in FIG. 8, the recording-medium conveyance assembly 11 includes a sheet feed unit 31, a sheet conveyance unit 32, and a sheet output unit 33. The sheet feed unit 31 feeds recording media 3 to the sheet conveyance unit 32. The sheet conveyance unit 32 conveys a recording medium 3 fed from the sheet feed unit 31 to a position opposing the inkjet head 4. The sheet output unit 33 outputs the recording medium 3 after recording. The sheet feed unit 31 has a sheet feed tray 34 and a sheet feed roller 35. The sheet feed tray 34 stacks the recording media 3 to be fed to the sheet conveyance unit 32. The sheet feed roller 35 separates the recording media 3 sheet by sheet from the sheet feed tray 34 and feed the recording media 3 sheet by sheet to the sheet conveyance unit 32.

The sheet conveyance unit 32 includes a conveyance guide 36, an endless conveyance belt 37, a conveyance roller 38, a tension roller 39, a rotary device 40, a pressing plate 41, a front end roller 42, a duplex pressing roller 43, a charging roller 44, the guide member 25, a tension roller 39, a registration roller 45, and a transport roller 46. The conveyance guide 36 turns the transport direction of the recording medium 3 fed from the sheet feed unit 31 approximately 90 degrees to the sub-scanning direction Y which is a substantially vertical direction. The conveyance belt 37 conveys the recording medium 3 with the recording medium 3 adhered thereon by static electricity. The tension roller 39 supports the conveyance belt 37 along with the conveyance roller 38. The rotary device 40 illustrated in FIG. 5 rotates the conveyance roller 38. The front end roller 42 is urged or pressed toward the conveyance belt 37 by the pressing plate 41. The duplex pressing roller 43 presses a side of the conveyance belt 37 opposite a side at which the pressing plate 41 is disposed. The charging roller 44 charges a surface of the conveyance belt 37. The guide member 25 is disposed at an inner side of a loop of the conveyance belt 37 so as to correspond to the printing area of the inkjet head 4. The registration roller 45 is pressed by the tension roller 39. The transport roller 46 is disposed downstream from the conveyance belt 37 in the transport direction of the recording medium 3. The conveyance roller 38 is mounted on a roller shaft 70 so as to rotate with the roller shaft 70.

Figure 5:
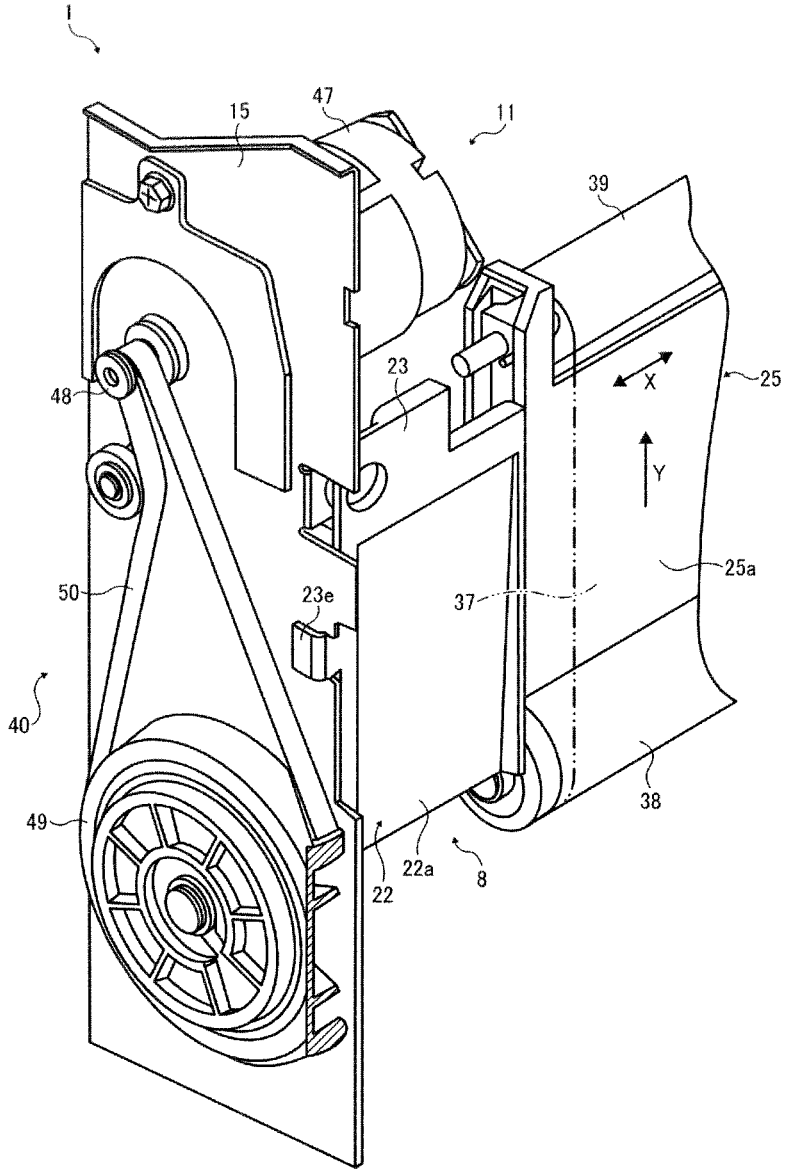
FIG. 5 is a schematic partial perspective view of the inkjet recording apparatus according to the first exemplary embodiment.

As illustrated in FIG. 5, the rotary device 40 includes a sub scanning motor 47, a driving pulley 48, a driven pulley 49, and an endless driving belt 50. The sub scanning motor 47 is disposed at a downstream side in the sub-scanning direction Y. The driving pulley 48 is mounted on the sub scanning motor 47. The driven pulley 49 is disposed at an upstream side in the sub-scanning direction Y and is mounted on the roller shaft 70 so as to rotate with the conveyance roller 38 via the roller shaft 70. The driving belt 50 is looped between the driving pulley 48 and the driven pulley 49.

As illustrated in FIG. 8, the guide member 25 has a carriage-side face 25*a* opposing the carriage 5 and projecting beyond a tangent line between the conveyance roller 38 and the tension roller 39. As a result, since the conveyance belt 37 is guided while being projected by the guide member 25, the flatness of the conveyance belt 37 at the printing area is maintained at high accuracy.

The carriage-side face 25*a* of the guide member 25 has grooves along the main scanning direction X, i.e., a direction perpendicular to the transport direction of the recording medium 3. Such a configuration reduces a contact area of the guide member 25 with the conveyance belt 37, thus allowing the conveyance belt 37 to smoothly move along the carriage-side face 25*a* of the guide member 25. The charging roller 44 is disposed to contact an outer layer of the conveyance belt 37 and rotate with circulation of the conveyance belt 37.

The sheet output unit 33 includes a sheet output tray 51, an output guide 52, sheet output rollers 53, and spurs 54. The sheet output tray 51 is horizontally disposed above the sheet feed tray 34. The output guide 52 guides the recording medium 3 to the sheet output tray 51 while turning the transport direction of the recording medium 3, which moves upward via the transport roller 46, approximately 90 degrees to a horizontal direction. The sheet output rollers 53 and the spurs 54 smoothly guide the recording medium 3.

In addition, the above-described respective units of the inkjet recording apparatus 1 are activated under control of a controller. The controller includes a central processing unit (CPU), a read only memory (ROM), a random access memory (RAM), a backup memory, an input interface circuit, and an output interface circuit. The ROM stores fixed data. The RAM temporarily stores data. The backup memory is a rewritable non-volatile memory. The output interface circuit includes a driving circuit and so on, Next, operation of the ink receiving assembly 8 is described below.

When the ink receiving assembly 8 is installed to the inkjet recording apparatus 1, as illustrated in FIGS. 6 and 7, the ink receiving plate 22 is installed to the holding groove 23*b* of the holder 23 and the engagement hole 22*b* is engaged with or hooked on the engagement protrusion 23*c*. As illustrated in FIG. 2, the guide-member-side protrusions 23*d* of the holder 23 are engaged with or fitted in the guide member 25, and the side-plate-side protrusion 23*e* is engaged with or hooked on the left side plate 15. The collection tank 24 is mounted on the left side plate 15.

When the inkjet recording apparatus 1 is powered on, the main scanning motor 17 is driven to move the carriage 5 in the main scanning direction X. As a result, the carriage 5 with the inkjet head 4 moves from the standby position opposing the reliability maintenance device 10 to a printing position.

The recording media 3 are separated and fed sheet by sheet from the sheet feed tray 34 and conveyed in the sub-scanning direction Y while being guided by the conveyance guide 36. The recording medium 3 is conveyed by the conveyance belt 37 and pressed against the conveyance belt 37 by the front end roller 42.

At this time, alternating voltages are supplied to the charging roller 44 so that plus outputs and minus outputs are alternately repeated. As a result, the conveyance belt 37 is charged in an alternating charged voltage pattern, that is, so that positively-charged band areas and negatively-charged hand areas are alternately repeated at a certain width in the sub-scanning direction Y, i.e., a circulating direction of the conveyance belt 37. When the recording medium 3 is fed onto the conveyance belt 37 alternately charged with positive and negative voltages, the recording medium 3 is electrostatically adhered on the conveyance belt 37 and conveyed in the sub scanning direction Y by the circulation of the conveyance belt 37. Then, the recording medium 3 is stopped at a predetermined position.

By driving the inkjet head 4 in accordance with image signals while moving the carriage 5 in the main scanning direction X, ink droplets 2 are ejected onto the recording medium 3 stopped to record one line. Then, after the recording medium 3 is fed by a certain distance, another line is recorded. Receiving a recording end signal or a signal indicating that a rear end of the recording medium 3 has arrived at the recording area, the recording operation is finished and the recording medium 3 is output to the sheet output tray 51.

During standby, the carriage 5 is moved to the reliability maintenance device 10 and the nozzles 9 are capped by the suction cap 26 and the moisture-retention cap 29. Thus, the nozzles 9 are maintained in humid state, thus preventing ejection failure due to drying of ink. In addition, before the start of recording or during recording, recovery operation is performed to eject ink not relating to the recording, thus maintaining stable ejection performance.

While the inkjet recording apparatus 1 is activated, the carriage 5 is regularly moved to the position opposing the ink receiving assembly 8. Ink droplets 2 are simultaneously ejected from all of the nozzles 9 of the inkjet head 4. The ejected ink droplets 2 arrive at the receiving face 22*a* of the ink receiving plate 22 without turning into mist, attach to and drop from the receiving face 22*a*, and are collected into the collection tank 24. Meanwhile, after the ejection of the ink droplets 2, the carriage 5 moves to the position opposing the recording medium 3 and restart printing.

When the receiving face 22*a* of the ink receiving plate 22 is soiled by long use, a user can clean the ink receiving plate 22 by wiping soil with a sheet of paper or a cotton swab with the ink receiving plate 22 mounted on the holder 23. Alternatively, a user can remove the ink receiving plate 22 from the holder 23 and clean the receiving face 22*a* or replace the ink receiving plate 22 with a new one. When a large amount of ink accumulates in the collection tank 24, a user can remove the collection tank 24, discard accumulated ink, and install the collection tank 24 again.

As described above, for the inkjet recording apparatus 1 according to this exemplary embodiment, the non-porous and hydrophilic receiving face 22*a* of the ink receiving plate 22 broader than the ejection range 21 of ink droplets 2 is disposed substantially vertically. In addition, the distance between the inkjet head 4 and the receiving face 22*a* is set to be 3 to 5 mm. As a result, ink droplets 2 ejected for dummy ejection from the inkjet head 4 land on the receiving face 22*a* of the ink receiving plate 22 before turning into mist. Without being absorbed by the ink receiving plate 22 and residing at a lowest portion of the ink receiving plate 22, the ink droplets 2 drop from the ink receiving plate 22 and are collected in the collection tank 24.

For such a configuration, the ink droplets 2 ejected for dummy ejection from the inkjet head 4 are fully collected by the receiving face 22*a* of the ink receiving plate 22, thus preventing suspension of the ink droplets 2 and occurrence of mist. In addition, such a configuration can prevent the porous sheet from deteriorating due to ink having remained and hardened at the lower end as in a case in which the ink droplets 2 ejected for dummy ejection from the inkjet head 4 are absorbed by a conventional type of porous sheet, thus preventing a reduction in the performance of the ink receiving plate 22 by long use.

For the inkjet recording apparatus 1 according to this exemplary embodiment, since the receiving face 22*a* is hydrophilic, ink droplets 2 turn into a liquid layer instead of forming droplets, thus preventing the ink droplets 2 from hardening with the ink droplets 2 adhering on the receiving face 22*a* in droplet form.

In addition, the inkjet recording apparatus 1 according to this exemplary embodiment has the receiving face 22*a* tilted to position an upper portion of the receiving face 22*a* of the ink receiving plate 22 at a side proximal to the inkjet head 4 and a lower portion of the receiving face 22*a* at a side distal to the inkjet head 4. Such a configuration allows ink droplets 2 landing on the receiving face 22*a* to smoothly move on the receiving face 22*a* downward and drop from the lowermost portion of the receiving face 22*a*, thus preventing a reduction in the performance of the ink receiving plate 22 due to firm adhesion of the ink droplets 2.

For the inkjet recording apparatus 1 according to this exemplary embodiment, since the receiving face 22*a* is a flat face, that is, has a simple shape, the ink receiving plate 22 is easy to be produced, thus minimizing production cost.

For the inkjet recording apparatus 1 according to this exemplary embodiment, the ink receiving plate 22 is made of a material meeting desired properties in contact with ink. Even when the ink receiving plate 22 contacts ink for a long period of time, such a configuration can prevent chemical reactions of the ink receiving plate 22 with ink components. As a result, such a configuration can prevent the receiving face 22*a* from being chemically dissolved to form microscopic asperities, thus preventing occurrence of mist due to the microscopic asperities and firm adherence of ink droplets 2 in the microscopic asperities.

In addition, the inkjet recording apparatus 1 according to this exemplary embodiment has the ink receiving plate 22 removably mountable relative to the holder 23. Such a configuration facilitates replacement of the ink receiving plate 22 when the ink receiving plate 22 is soiled or deteriorates.

The inkjet recording apparatus 1 according to this exemplary embodiment also has the collection tank 24 removably mountable. Such a configuration allows replacement of the collection tank 24 itself when the collection tank 24 is filled with ink, thus facilitating collection of ink.

As described above, for the inkjet recording apparatus 1 according to this exemplary embodiment, the ink receiving plate 22 of the ink receiving assembly 8 is removably mountable relative to the holder 23. It is to be noted that the configuration of the ink receiving assembly is not limited to the above-described configuration but, for example, the holder 23 and the ink receiving plate 22 may be integrated as a single unit. Such a configuration can simplify the structure of the ink receiving assembly 8, thus reducing the production cost of components.

As described above, for the inkjet recording apparatus 1 according to this exemplary embodiment, the ink receiving plate 22 is tilted. However, it is to be noted that the configuration of the ink receiving plate is not limited to the above-described configuration but, for example, the ink receiving plate 22 may be vertically disposed. In such a case, the distance between the inkjet head 4 and the ink receiving plate 22 is preferably 5 mm or less. Such a configuration can reduce the setting space of the ink receiving plate 22 in the thickness direction, thus reducing the size of the inkjet recording apparatus 1.

As described above, for the inkjet recording apparatus 1 according to this exemplary embodiment, when the receiving face 22*a* of the ink receiving plate 22 is soiled, a user can clean the receiving face 22*a* or replace the ink receiving plate 22. However, it is to be noted that the configuration of the inkjet recording apparatus is not limited to the above-described configuration but the inkjet recording apparatus may have a cleaning device to clean the receiving face 22*a* of the ink receiving plate 22.

For example, as illustrated in FIGS. 10A, 10B, 11A and 11B, a cleaning device 60 including a wiper 61, an engagement member 62, and an urging member 63 may be provided. The wiper 61 is swingable between an original position 61*a* illustrated in FIGS. 10A and 10B and a turnaround position 61*b* illustrated in FIGS. 11A and 11B. The engagement member 62 is integrally provided with the wiper 61 to engage or contact one end face in a moving direction of the inkjet head 4. The urging member 63 is, e.g., an urging spring made of, e.g., a torsion coil spring to urge, i.e., apply a restoring force to the wiper 61 in a direction to return the wiper 61 to the original position 61*a*.

Figure 10A:
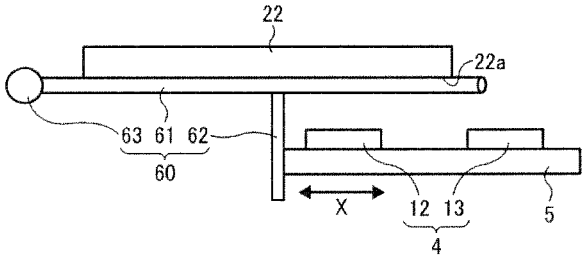
FIG. 10A is a schematic plan view of a cleaning device of the inkjet recording apparatus according to the first exemplary embodiment in a state in which the inkjet head is placed away from in front of the ink receiving plate.
Figure 10B:
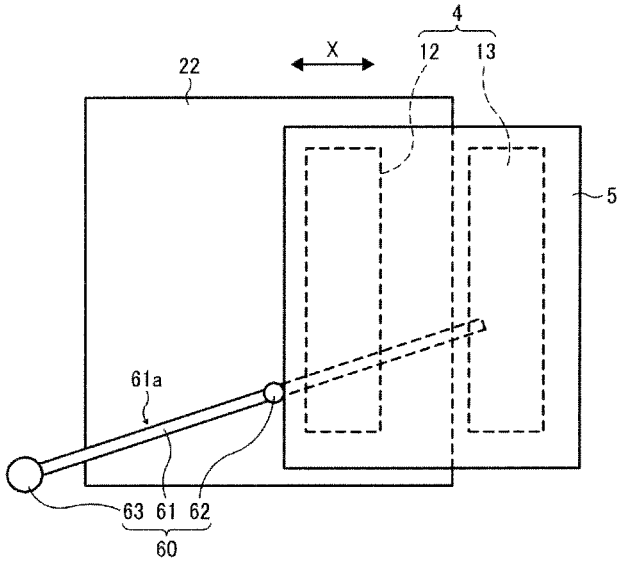
FIG. 10B is a schematic front view of the cleaning device of FIG. 10A.
Figure 11A:
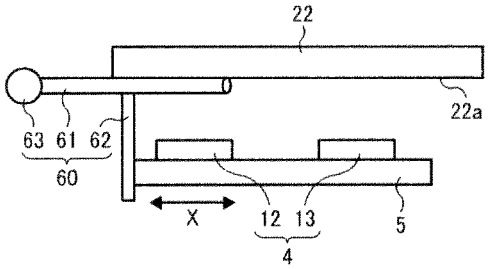
FIG. 11A is a schematic plan view of the cleaning device of FIG. 10A in a state in which the inkjet head is placed in front of the ink receiving plate.
Figure 11B:
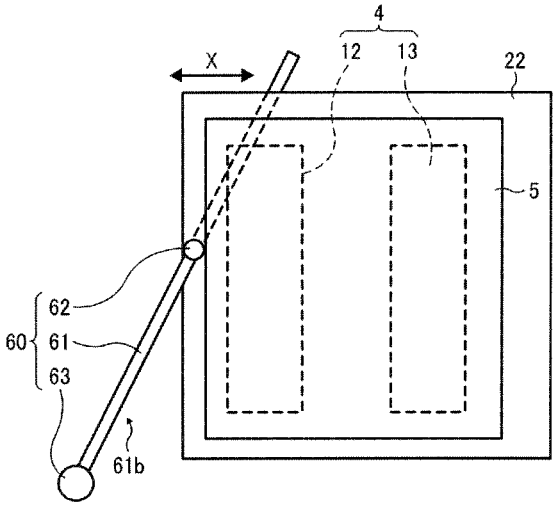
FIG. 11B is a schematic front view of the cleaning device of FIG. 11A.

As illustrated in FIGS. 10A and 10B, when the carriage 5 is separated from the engagement member 62 with the carriage 5 and the inkjet head 4 placed away from in front of the ink receiving plate 22, the wiper 61 is urged by or receives the restoring force of the urging member 63 to return to the original position 61*a*. As illustrated in FIGS. 11A and 11B, when the carriage 5 contacts the engagement member 62 with the carriage 5 and the inkjet head 4 placed in front of the ink receiving plate 22, the wiper 61 is placed at the turnaround position 61*b* against the restoring force of the urging member 63.

As the carriage 5 and the inkjet head 4 move from the position illustrated in FIGS. 10A and 10B away from in front of the ink receiving plate 22 to the position illustrated in FIGS. 11A and 11B in front of the ink receiving plate 22, the wiper 61 swings from the original position 61*a* to the turnaround position 61*b*. By contrast, as the carriage 5 and the inkjet head 4 move from the position illustrated in FIGS. 11A and 11B in front of the ink receiving plate 22 to the position illustrated in FIGS. 10A and 10B away from in front of the ink receiving plate 22, the wiper 61 swings from the turnaround position 61*b* to the original position 61*a*.

As described above, by swinging between the original position 61*a* and the turnaround position 61*b*, the wiper 61 wipes ink droplets 2 adhered on the receiving face 22*a* of the ink receiving plate 22 to clean the receiving face 22*a* of the ink receiving plate 22. Such a configuration allows the receiving face 22*a* to be cleaned by the wiper 61 each time the inkjet head 4 performs dummy ejection using the ink receiving assembly 8, thus further reliably preventing an increase in viscosity or firm adherence of ink droplets 2 on the receiving face 22*a*. In addition, since the cleaning operation is automatically performed, the above-described configuration can facilitate maintenance without reducing the operability.

Figure 12A:
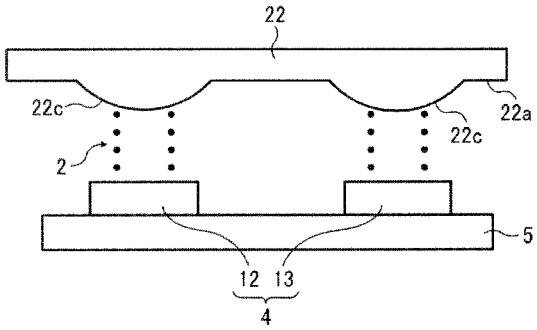
FIG. 12A is a schematic plan view of another example of the ink receiving plate of the inkjet recording apparatus according to the first exemplary embodiment in which a receiving face has curved concave portions.
Figure 12B:
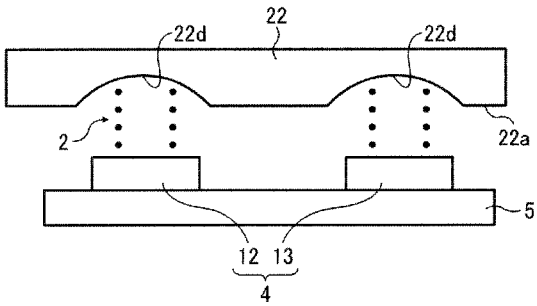
FIG. 12B is a schematic plan view of still another example of the ink receiving plate of the inkjet recording apparatus according to the first exemplary embodiment in which a receiving face has curved convex portions.

As described above, for the inkjet recording apparatus 1 according to this exemplary embodiment, the receiving face 22*a* of the ink receiving plate 22 is flat. However, it is to be noted that the receiving face is not limited to the flat face but may be a curved face. For example, as illustrated in FIG. 12A, the receiving face 22*a* may have convex curved faces 22*c* at positions opposing the nozzles 9. Alternatively, as illustrated in FIG. 12B, the receiving face 22*a* may have concave curved faces 22*d* at positions opposing the nozzles 9. In such cases, the distance from the nozzles 9 to the convex curved faces 22*c* or concave curved faces 22*d* is preferably 5 mm or less. Such configurations can provide a broader landing area of ink droplets 2 than the configuration in which the receiving face 22*a* is flat, thus allowing more effective collection of ink droplets.

As described above, for the inkjet recording apparatus 1 according to this exemplary embodiment, the clearance between the receiving these 22*a* of the ink receiving plate 22 and the inkjet head 4 is set to be 3 to 5 mm to prevent occurrence of ink mist. However, it is to be noted that the clearance is not limited to the above-described range. Since the distance at which mist does not occur varies with, e.g., the density, radius, and/or ejection speed of ink droplets, the clearance may be set to be within any other suitable range.

Second Exemplary Embodiment

A second exemplary embodiment of this disclosure has a general configuration substantially the same as that of the above-described first exemplary embodiment. Except for the configuration of an ink receiving assembly 208, an inkjet recording apparatus 201 according to this second exemplary embodiment is substantially the same as the inkjet recording apparatus 1 according to the first exemplary embodiment. Therefore, the same components and elements are described using the same reference codes as those of the first exemplary embodiment illustrated in FIGS. 2 to 9B, and features of the second exemplary embodiment differing from the first exemplary embodiment are mainly described below.

Figure 13:
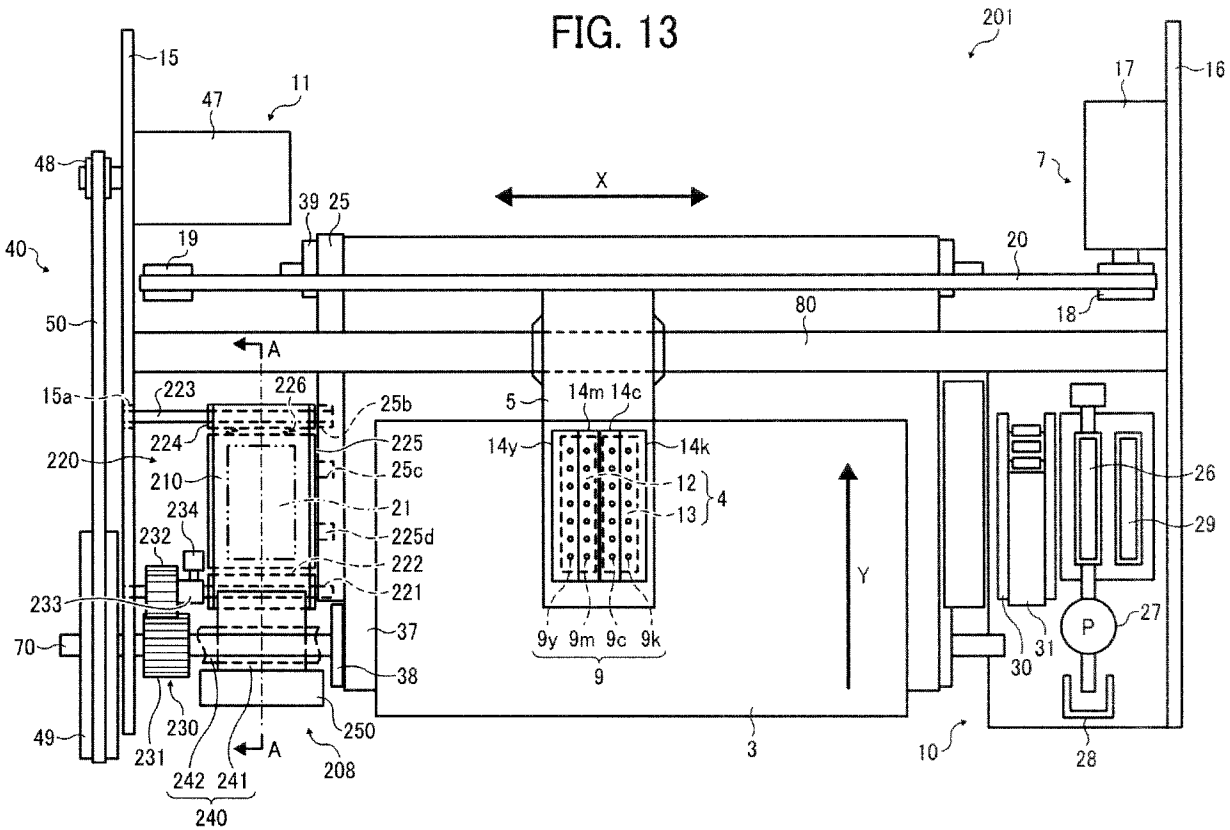
FIG. 13 is a schematic front view of an inkjet recording apparatus according to a second exemplary embodiment of this disclosure.
Figure 14:
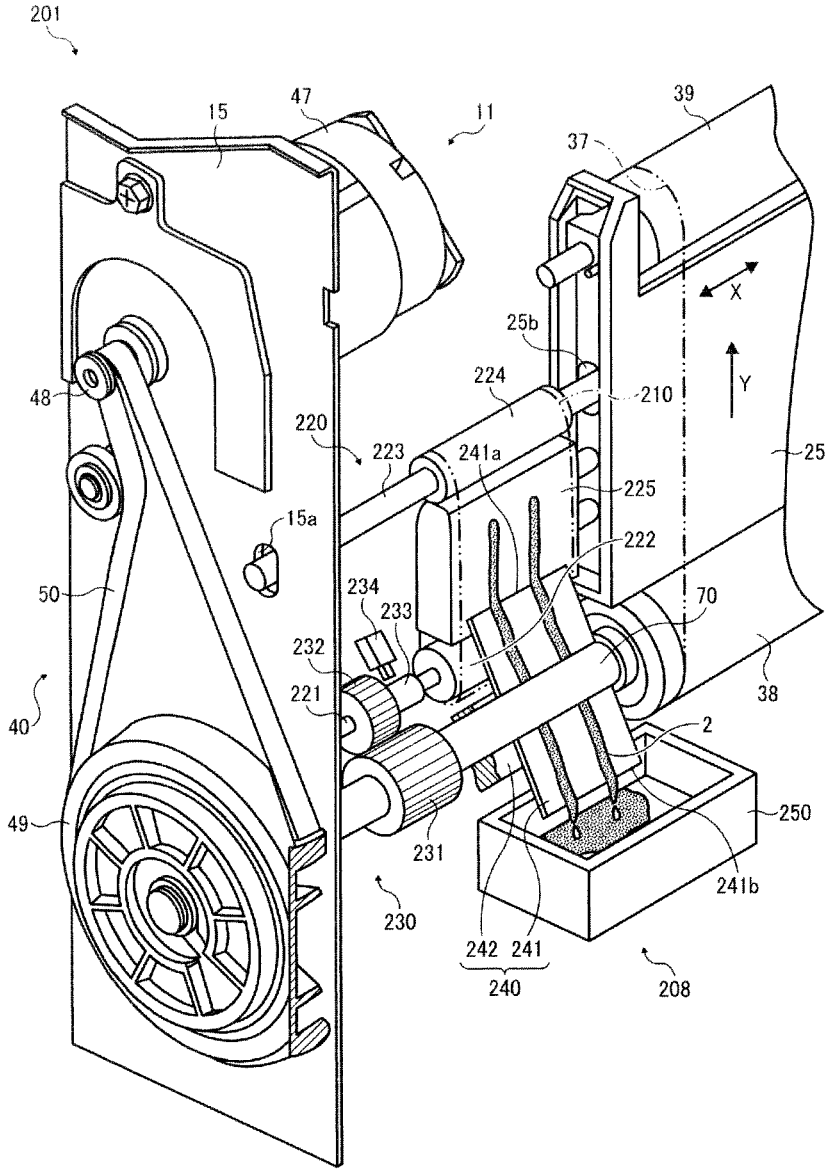
FIG. 14 is a schematic partial perspective view of the inkjet recording apparatus according to the second exemplary embodiment.

As illustrated in FIGS. 13, 14, 15A and 15B, the ink receiving assembly 208 in this exemplary embodiment is disposed at a non-printing area at the left side in a main scanning direction indicated by an arrow X of FIGS. 13 and 14. The ink receiving assembly 208 includes an ink receiving belt 210, a support device 220, a rotary device 230, a scraping device 240, and a collection tank 250.

At the outer surface side, the ink receiving belt 210 has a receiving face 210*a* to receive ink. The ink receiving belt 210 is endless and is made of a non-porous material. In this exemplary embodiment, the ink receiving belt 210 is made of, e.g., PET resin. Such PET resin meets desired properties in contact with ink and can minimize chemical reactions of the ink receiving belt 210 with ink components, thus enhancing the corrosion resistance against ink components. In addition, PET resin is advantageous in, e.g., flexibility, bending strength, and tensile strength, thus enhancing the mechanical strength and durability of the ink receiving belt 210. Such a material meeting desired properties in contact with ink, flexibility, bending strength, tensile strength, and so on are not limited to PET resin but may be, for example, polyphenylene sulfide (PPS) resin. As with PET resin, PPS resin can provide desired properties in contact with ink, flexibility, bending strength, tensile strength, and so on.

The ink receiving belt 210 is water repellent. Thus, ink adhered on the receiving face 210*a* of the ink receiving belt 210 can be easily scraped off by the scraping device 240 as described below. The thickness of the ink receiving belt 210 is set to be, for example, approximately 0.075 mm. However, it is to be noted that the thickness of the ink receiving belt 210 may be any other suitable amount in consideration of flexibility and/or cost.

The support device 220 includes a driving roller shaft 221, a driving roller 222, a driven roller shaft 223, a driven roller 224, a belt holder 225, and pressing springs 226.

The driving roller shaft 221 is arranged near and parallel to the roller shaft 70 of a conveyance roller 38. The driving roller shaft 221 is rotatably supported at opposed end portions by a guide member 25 and a left side plate 15. The driving roller 222 is mounted on and rotatable with the driving roller shaft 221.

The driven roller shaft 223 is arranged above and parallel to the driving roller shaft 221. The driven roller shaft 223 is rotatably supported at opposed end portions by the guide member 25 and the left side plate 15. The guide member 25 has an oblong recessed portion serving as a support portion 25*b* to support the driven roller shaft 223. The driven roller shaft 223 is slightly movable in the support portion 25*b* in the vertical direction. In addition, the left side plate 15 has an oblong through hole serving as a support portion 15*a* to support the driven roller shaft 223. The driven roller shaft 223 is slightly movable in the support portion 25*a* in the vertical direction.

The driven roller 224 is mounted on and rotatable with the driven roller shaft 223. The ink receiving belt 210 is looped around the driving roller 222 and the driven roller 224. Thus, a bending portion 210*b* bent by the driving roller 222 of the rotary device 230 is formed below an area of the ink receiving belt 210 opposing the inkjet head 4.

The belt holder 225 is a flat plate of synthetic resin and vertically disposed between the driving roller 222 and the driven roller 224. The belt holder 225 has a belt support portion 225*a*, a belt guide portion 225*b*, a spring holding portion 225*c*, and supporting projections 225*d*.

The belt support portion 225*a* is a side face portion of the belt holder 225 proximal to a carriage 5, has a flat shape, and presses the ink receiving belt 210 from a back face side of the ink receiving belt 210 to maintain the flatness of the ink receiving belt 210. The clearance between the nozzle faces of the inkjet head 4 and the ink receiving belt 210 is set to be 2 mm. Such a configuration allows ink droplets 2 ejected from the inkjet head 4 to land on the ink receiving belt 210 without turning into mist.

The belt guide portion 225*b* is formed continuously with the belt support portion 225*a* at an upper portion of the belt holder 225 and has a slanted face so that the thickness of the belt guide portion 225*b* decreases upward. The corners of the belt guide portion 225*b* are rounded. Such a configuration allows the belt guide portion 225*b* to smoothly guide the ink receiving belt 210 between the driven roller 224 and the belt support portion 225*a*.

The spring holding portion 225*c* is disposed at a top of the belt guide portion 225*b*. The spring holding portion 225*c* supports the pressing springs 226. The supporting projections 225*d* (two projections in this exemplary embodiment) are disposed at a side portion of the belt holder 225 proximal to the guide member 25. Each of the supporting projections 225*d* is supported by a support hole 25*c* of the guide member 25.

The pressing springs 226 (two springs in this exemplary embodiment) are compression coil springs disposed between the upper end portion of the belt holder 225 and the driven roller shaft 223. The pressing springs 226 support the driven roller shaft 223 relative to the belt holder 225 while pressing the driven roller shall 223 upward. As a result, the driven roller 224 presses the ink receiving belt 210 upward from the inner side of the ink receiving belt 210, thus acting as a tensioner to apply tension to the ink receiving belt 210.

The rotary device 230 includes a first gear 231, a second gear 232, a clutch 233, and a solenoid 234. The first gear 231 is mounted on and rotates with the roller shaft 70. The second gear 232 is rotatably mounted on the driving roller shaft 221.

The clutch 233 is mounted adjacent to the second gear 232 on the driving roller shaft 221. The clutch 233 has a stopper 233*a* of a convex shape outside and a torsion coil spring inside.

Figure 15A:
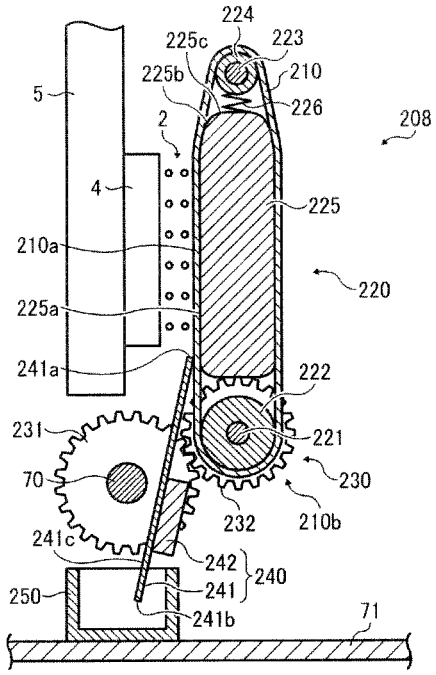
FIG. 15A is a cross sectional view of an ink receiving assembly of the inkjet recording apparatus according to the second exemplary embodiment cut along A-A line in FIG. 13.
Figure 15B:
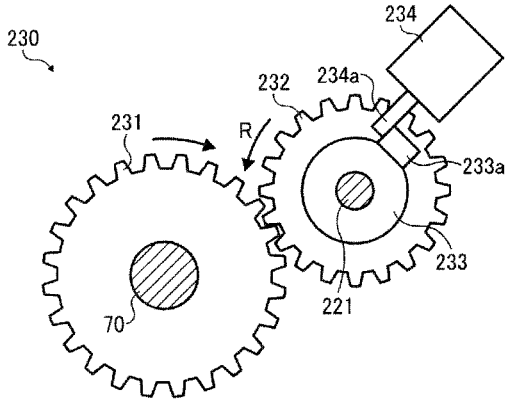
FIG. 15B is a side view of a rotary device of the inkjet recording apparatus according to the second exemplary embodiment.

When the clutch 233 is freely rotatable without being regulated by an external component, the torsion coil spring is tightened with rotation of the second gear 232 in a direction indicated by an arrow R in FIG. 15B and the clutch 233 rotates with the driving roller shaft 221. As described above, the rotatable state of the clutch 233 is referred to as "on state" of the clutch 233. When the clutch 233 is in the on state, the second gear 232 and the driving roller shaft 221 integrally rotate via the clutch 233.

When the clutch 233 is in non-rotatable state by regulation of an external component, the torsion coil spring is not tightened with rotation of the second gear 232 in the direction indicated by an arrow R in FIG. 15B. As a result, the clutch 233 does not rotate with the driving roller shaft 221. As described above, the non-rotatable state of the clutch 233 is referred to as "off state" of the clutch 233. When the clutch 233 is in the off state of the clutch 233, the clutch 233 and the driving roller shaft 221 remain stopped and only the second gear 232 idles.

The solenoid 234 is disposed near the clutch 233. The solenoid 234 has a pin 234*a* projectable and retractable in response to voltage application. In this exemplary embodiment, in a regular state in which voltage is not applied, the pin 234*a* of the solenoid 234 is projected. By contrast, in an energized state in which voltage is applied, the pin 234*a* of the solenoid 234 is retracted.

As illustrated in FIG. 15B, in the regular state, the solenoid 234 projects the pin 234*a* outward. In this time, the stopper 233*a* of the clutch 233 contacts the pin 234*a* and turns into non-rotatable state, thus stopping the rotation of the clutch 233. By contrast, in the energized state, the solenoid 234 retracts the pin 234*a* inward. In this time, the stopper 233*a* turns into rotatable state without contacting the pin 234*a*, thus continuing the rotation of the clutch 233.

The scraping device 240 includes a scraper 241 and a support frame 242. The scraper 241 is a rectangular thin plate and disposed at a lower portion at a side of the ink receiving belt 210 proximal to the carriage 5.

The scraper 241 of the scraping device 240 is a flat plate having, e.g., an upper edge portion 241*a*, a lower edge portion 241*b*, and a scraping face 241*c*. The upper edge portion 241*a* contacts the receiving face 210*a* to scrape ink droplets 2. The scraping face 241*c* is formed continuously with the upper edge portion 241*a* to flow scraped ink droplets 2 thereon. The lower edge portion 241*b* drops the ink droplets 2 flowing on the scraping face 241*c* downward therefrom.

The scraper 241 is made of a material meeting desired properties in contact with ink, for example, a transparent material of PET resin. The material meeting desired properties in contact with ink is not limited to PET resin but may be, for example, a transparent material of acrylic (polymethyl methacrylate: PMMA). In addition, the material is not limited to transparent material but may be, for example, polyacetal resin (POM) or epoxy resin (PE). Even when the scraper 241 contacts ink for a long period of time, such a configuration can minimize chemical reactions of the scraper 241 with ink components, thus enhancing the corrosion resistance against ink components.

The thickness of the scraper 241 is set to be approximately 0.1 mm, more specifically, e.g., 0.125 mm. However, it is to be noted that the thickness of the scraper 241 may be any other suitable amount in consideration of mechanical strength and/or cost.

The upper edge portion 241*a* of the scraper 241 horizontally contacts the ink receiving belt 210. Thus, when the ink receiving belt 210 contacting the scraper 241 rotates downward, ink droplets 2 adhered on an outer surface of the scraper 241 goes over and is scraped by the scraper 241.

The lower edge portion 241*b* of the lower edge portion 241*b* is inserted in the collection tank 250. Thus, the ink droplets 2 scraped by the upper edge portion 241*a* move down on the scraping face 241*c* forming the outer surface of the scraper 241 to the lower edge portion 241*b*, and drop from the lower edge portion 241*b* to the collection tank 250. In this exemplary embodiment, the scraper 241 is made of PET resin and water repellent. Thus, the ink droplets 2 scraped from the ink receiving belt 210 by the scraper 241 can move down on the scraping face 241*c* forming the outer surface of the scraper 241 and easily drop downward.

Figure 18:
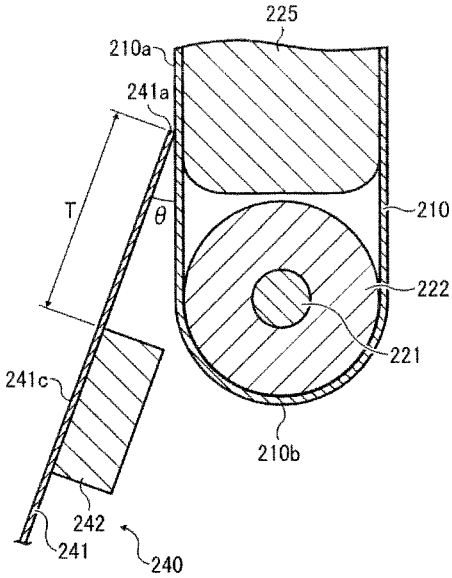
FIG. 18 is a cross sectional view of a portion of the ink receiving assembly of the inkjet recording apparatus according to the second exemplary embodiment cut along A-A line in FIG. 13.

The scraper 241 is tilted 20 degrees from the upper edge portion 241*a* toward the lower edge portion 241*b* in a direction away from the ink receiving belt 210. As a result, the scraper 241 is positioned so as to have an acute angle of 20 degrees relative to the ink receiving belt 210 at the upper edge portion 241*a*. In other words, the scraping device 240 is disposed so that the scraping face 241*c* has an acute angle relative to the receiving face 210*a* of the ink receiving belt 210. Thus, ink droplets 2 landing on the ink receiving belt 210 can be effectively scraped by wedge effect, As illustrated in FIG. 18, the upper edge portion 241*a* of the scraper 241 contacts a plane portion of the ink receiving belt 210 backed by a lower portion of the belt holder 225. The contact angle θ of the scraper 241 with the ink receiving belt 210 is, e.g., 20 degrees. The contact angle θ can be set to be any other suitable angle in accordance with the viscosity of ink droplets 2 and the hardness and desired properties in contact with ink of the scraper 241 and the ink receiving belt 210. However, in the viewpoint of the effect of scraping ink droplets 2, the contact angle θ is preferably within a range of 10 to 30 degrees, most preferably 20 degrees.

The protruding length Tat which the scraper 241 protrudes beyond an upper edge of the support frame 242 toward the upper edge portion 241*a* is set to be, e.g., 8.7 mm. The deformation depth at which the ink receiving belt 210 is deformed by the upper edge portion 241*a* of the scraper 241 pressing the ink receiving belt 210 toward the belt holder 225 is set to be, e.g., 0.8 mm. The protruding length T of the scraper 241 and the deformation depth of the ink receiving belt 210 depend on the pressing force of the upper edge portion 241*a* of the scraper 241 against the ink receiving belt 210. The protruding length T of the scraper 241 and the deformation depth of the ink receiving belt 210 may be set to be any other suitable amounts in accordance with the viscosity of ink droplets 2 and the hardness and desired properties in contact with ink of the ink receiving belt 210.

The support frame 242 is disposed at a lower side of the scraper 241 to support the scraper 241 from the lower side. The support frame 242 is supported by a frame.

The collection tank 250 is disposed below the lower edge portion 241*b* of the scraper 241 to collect ink droplets 2 dropping from the lower edge portion 241*b* of the scraper 241. The collection tank 250 is removably mountable relative to a lower frame 71.

Next, operation of the ink receiving device 208 in this exemplary embodiment is described with reference to FIG. 16.

The ink receiving device 208 operates based on programs recorded on the controller.

While the inkjet recording apparatus 1 is activated, the carriage 5 is regularly moved to the position opposing the ink receiving assembly 208. At this time, the carriage 5 is moved to the same position every time. Then, ink droplets 2 are simultaneously ejected front the nozzles 9 of the inkjet head 4 to the ejection range 21 of the ink receiving belt 210 for dummy ejection. The ejected ink droplets 2 all arrive at and land on the ink receiving belt 210 without turning into mist. Thus, dummy ejection is completed at S1, After the completion of dummy ejection, the carriage 5 moves to the position opposing the recording medium 3 and start printing again. At the completion of dummy ejection, the solenoid 234 is not electrified and the pin 234*a* of the solenoid 234 protrudes out. As a result, since the front end of the pin 234*a* contacts the stopper 233*a*, the clutch 233 cannot rotate. Thus, since the second gear 232 idles and the driving roller shaft 221 and the driving roller 222 do not rotate, the ink receiving belt 210 is stopped.

By contrast, after the completion of dummy ejection, the solenoid 234 is electrified. As a result, the pin 234*a* of the solenoid 234 is retracted inward and the front end of the pin 234*a* disengages from the stopper 233*a*. Then, the clutch 233 is rotated by the second gear 232 and turns into "on state" at S2. Thus, the second gear 232 rotates with the driving roller shaft 221. At S3, the roller shaft 70 is connected to the driving roller shaft 221 via the first gear 231 and the second gear 232.

At S4, the controller resets to zero a drive timer T that measures a time for rotating the ink receiving belt 210. At S5, the ink receiving belt 210 rotates.

At S6, the controller determines whether or not the drive timer T goes beyond a preset threshold time. The preset threshold time is set to be, e.g., a time for which the ink receiving belt 210 rotates during which ink droplets 2 ejected on the ink receiving belt 210 are fully scraped by the scraper 241. When the controller determines that the drive timer T does not go beyond the preset threshold time (No at S6), at S5 the controller continues rotating the ink receiving belt 210.

Figure 19:
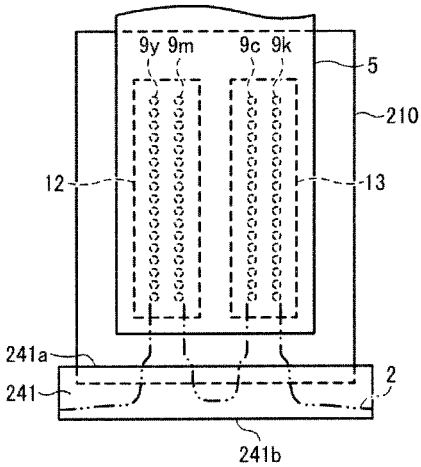
FIG. 19 is a front view of a scraper, an ink receiving belt, and ink flow in the second exemplary embodiment.

As illustrated in FIG. 19, when the ink receiving belt 210 rotates downward, ink droplets 2 ejected on the ink receiving belt 210 are scraped by the upper edge portion 241*a* of the scraper 241. The ink droplets 2 scraped by the scraper 241 flow down on the outer surface of the scraper 241, spread across the lower edge portion 241*b* of the scraper 241, and drop down from the lower edge portion 241*b* to the collection tank 250.

Figure 16:
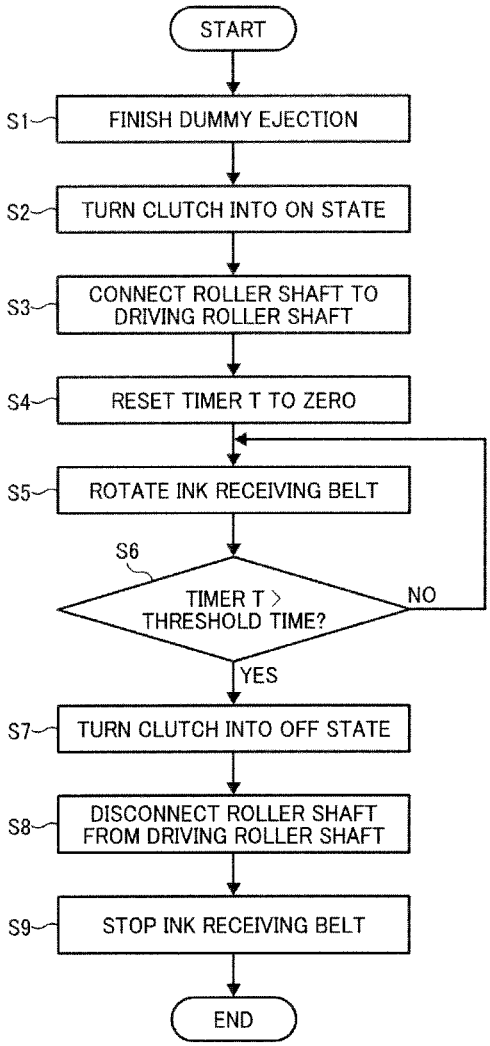
FIG. 16 is a flowchart of operation of the ink receiving assembly of the inkjet recording apparatus according to the second exemplary embodiment.

As illustrated in FIG. 16, when the controller determines that the drive timer T goes beyond the threshold time (YES at S6), it is determined that the ink droplets 2 ejected on the ink receiving belt 210 have been fully scraped by the scraper 241. When the controller stops the electrification of the solenoid 234, the pin 234*a* protrudes out and the front end of the pin 234*a* contacts the stopper 233*a*. Since the front end of the pin 234*a* contacts the stopper 233*a*, at S7 the clutch 233 stops rotating and turns into off state. At S8, the second gear 232 idles and the connection of the roller shaft 70 to the driving roller shaft 221 is released. As a result, since the driving roller shaft 221 and the driving roller 222 stop rotating, at S9 the ink receiving belt 210 stops.

As described above, the inkjet recording apparatus 201 according to this exemplary embodiment performs dummy ejection with the inkjet head 4 opposing the non-porous ink receiving belt 210 substantially vertically oriented. The distance between the inkjet head 4 and the ink receiving belt 210 is set to be 2 mm. Such a configuration allows the ink droplets 2 ejected from the inkjet head 4 by dummy ejection to land on the ink receiving belt 210 before turning into mist, thus preventing the ink droplets 2 from being absorbed into the ink receiving belt 210.

In addition, for the inkjet recording apparatus 201, the ink receiving belt 210 on which ink droplets 2 land moves downward, and the scraper 241 is disposed at the lower side of the ink receiving belt 210. Such a configuration allows ink droplets 2 to be scraped more immediately after ejection than a configuration in which, as conventionally performed, ink droplets are scraped at a side of the ink receiving belt opposite a side on which the ink droplets land. As a result, such a configuration can minimize the range in which ink adheres on the ink receiving belt 210, thus preventing ink from dropping from side edges of the ink receiving belt 210. Such a configuration allows ink to be scraped before evaporation of the moisture from ink just after ejection, thus preventing ink from firmly adhering on the ink receiving belt 210.

The inkjet recording apparatus 201 according to this exemplary embodiment uses the roller shaft 70 as a driving source of the driving roller 222 to rotate the ink receiving belt 210. Such a configuration obviates the necessity of a dedicated driving source for rotating the ink receiving belt 210, thus minimizing the number of components and cost.

For the inkjet recording apparatus 201 according to this exemplary embodiment, the time length during which the ink receiving belt 210 rotates after dummy ejection is set to be a time length during which ink droplets 2 ejected on the ink receiving belt 210 are fully scraped by the scraper 241. Such a configuration can minimize the number of rotations of the ink receiving belt 210, thus extending the product life of the ink receiving device 208.

The inkjet recording apparatus 201 according to this exemplary embodiment has the collection tank 250 removably mountable. Such a configuration allows replacement of the collection tank 250 itself when the collection tank 250 is filled with ink, thus facilitating collection of ink.

For the inkjet recording apparatus 201 according to this exemplary embodiment, the ink receiving belt 210 is made of a material meeting desired properties in contact with ink. Even when the ink receiving belt 210 contacts ink for a long period of time, such a configuration can prevent chemical reactions of the ink receiving belt 210 with ink components. As a result, such a configuration can prevent chemical dissolution of the ink receiving belt 210 and formation of minute irregularities, thus preventing a phenomenon that ink droplets 2 would be likely to turn into mist due to such minute irregularities of the ink receiving belt 210 and a phenomenon that ink droplets 2 would be likely to accumulate in and firmly adhere on such irregularities.

For the inkjet recording apparatus 201 according to this exemplary embodiment, the ink receiving belt 210 is water repellent. Such a configuration allows ink adhering on the ink receiving belt 210 to be easily scraped by the scraper 241, thus preventing ink from remaining adhering on the outer surface of the ink receiving belt 210.

For the inkjet recording apparatus 201 according to this exemplary embodiment, the scraper 241 is rectangular and the lower edge portion 241*b* is horizontally straight. Such a configuration can shorten the longitudinal length of the scraper 241. The longitudinal length of the scraper 241 can be set to be any suitable length in consideration of the setting position and/or longitudinal length of the support frame 242. To facilitate the flowing down of ink droplets 2 to prevent their accumulation, the longitudinal length of the scraper 241 is preferably shorter. As described above, the inkjet recording apparatus 201 according to this exemplary embodiment can reduce the longitudinal length of the scraper 241, thus facilitating the flowing down of ink droplets 2 and preventing the accumulation of ink droplets 2. In addition, such a reduced longitudinal length of the scraper 241 allows cost reduction and minimizes the size of the inkjet recording apparatus 201.

Figure 20A:
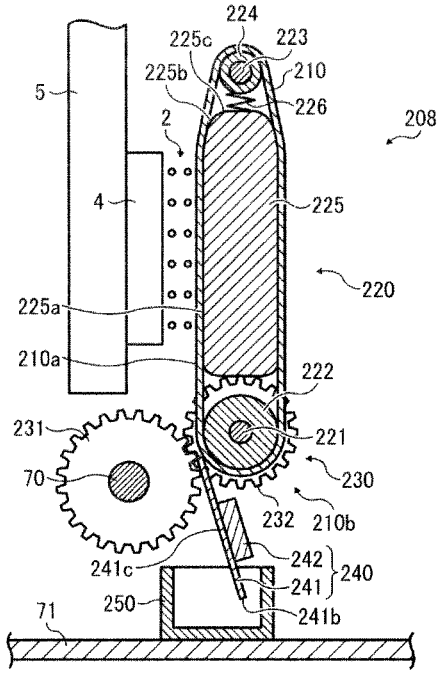
FIG. 20A is a vertical cross sectional view of the ink receiving assembly of the inkjet recording apparatus according to the second exemplary embodiment.

For the above-described inkjet recording apparatus 201 according to this exemplary embodiment, the upper edge portion 241*a* of the scraper 241 contacts the plane portion of the ink receiving belt 210 backed by the belt holder 225. However, it is to be noted that the inkjet recording apparatus is not limited to the above-described configuration but, for example, as illustrated in FIG. 20A, the upper edge portion 241*a* of the scraper 241 may contact the bending portion 210*b* forming a curved face of the ink receiving belt 210. In such a case, the scraping face 241*c* of the scraper 241 is tilted downward. As compared with a configuration in which the scraping face 241*c* is tilted upward, such a configuration facilitates ink droplets 2 adhered on the scraping face 241*c* to flow downward, thus further preventing accumulation of ink droplets 2.

Figure 20B:
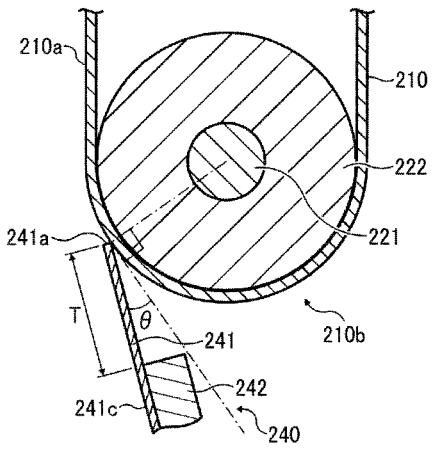
FIG. 20B is an enlarged vertical cross sectional view of a portion of the ink receiving assembly of FIG. 20A.

In such a case, as illustrated in FIG. 20B, the contact angle θ of the scraper 241 with the ink receiving belt 210 is preferably within a range of 10 to 30 degrees, most preferably20 degrees in the viewpoint of the effect of scraping ink droplets 2. The protruding length Tat which the scraper 241 protrudes beyond an upper edge of the support frame 242 toward the upper edge portion 241*a* is set to be, e.g., 8.7 mm. The deformation depth at which the ink receiving belt 210 is deformed by the upper edge portion 241*a* of the scraper 241 pressing the ink receiving belt 210 toward the belt holder 225 is set to be, e.g., 0.8 mm. The protruding length T of the scraper 241 and the deformation depth of the ink receiving belt 210 may be set to be any other suitable amounts in accordance with the viscosity of ink droplets 2 and the hardness and desired properties in contact with ink of the ink receiving belt 210.

As described above, for the inkjet recording apparatus 201 according to this exemplary embodiment, the scraper 241 is a flat plate. However, it is to be noted that the configuration of the scraper is not limited to the above-described flat plate but may be, for example, a wedge shape.

Figure 21A:
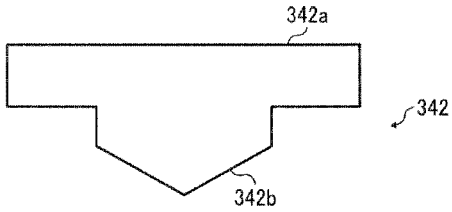
FIG. 21A is a front view of a scraper having a lower end portion of a home base shape in an exemplary embodiment of this disclosure.
Figure 21B:
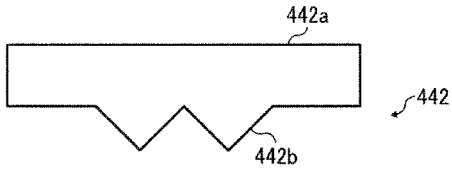
FIG. 21B is a front view of a scraper having a lower end portion of a W shape in an exemplary embodiment of this disclosure.
Figure 21C:
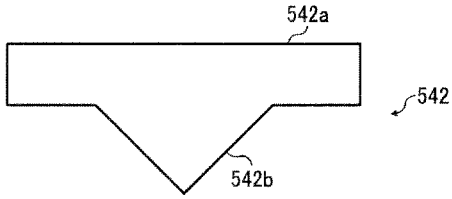
FIG. 21C is a front view of a scraper having a lower end portion of a V shape in an exemplary embodiment of this disclosure.
Figure 21D:
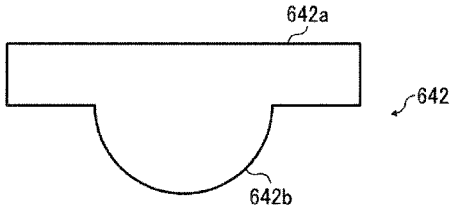
FIG. 21D is a front view of a scraper having a lower end portion of a semicircular shape n an exemplary embodiment of this disclosure.
Figure 21E:
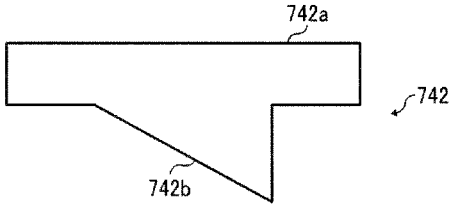
FIG. 21E is a front view of a scraper having a lower end portion of triangular shape with two vertexes placed at its right side in an exemplary embodiment of this disclosure.

For the inkjet recording apparatus 201 according to this exemplary embodiment, the scraper 241 is rectangular and the lower edge portion 241*b* is horizontally linear. However, it is to be noted that the configuration of the scraper is not limited to the above-described shape but, for example, a portion of the lower edge portion 241*b* may protrude downward. For example, as illustrated in FIG. 21 A, a scraper 342 may be provided with a lower edge portion 342*b* having a home-base shape. As illustrated in FIG. 21B, a scraper 442 may be provided with a W-shaped lower edge portion 442*b*. As illustrated in FIG. 21C, a scraper 542 may be provided with a V-shaped lower edge portion 542*b*. Alternatively, for example, as illustrated in FIG. 21D, a scraper 642 may be provided with a semicircular lower edge portion 642*b*. As illustrated in FIG. 21E, a scraper 742 may be provided with a lower edge portion 742*b* of a triangular shape with two vertexes placed at the left or right side. In the scrapers 342 to 742, the widths of upper edge portions 342*a*, 442*a*, 542*a*, 642*a*, and 742*a* are greater than those of the lower edge portions 342*b*, 442*b*, 542*b*, 642*b*, and 742*b*, respectively.

Figure 17A:
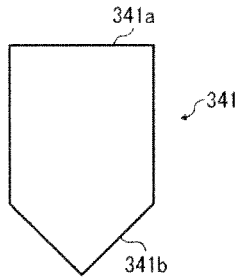
FIG. 17A is a front view of a scraper generally having a home base shape in an exemplary embodiment of this disclosure.
Figure 17B:
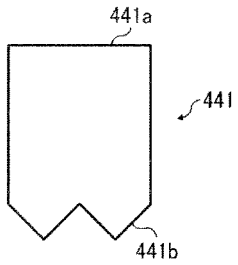
FIG. 17B is a front view of a scraper having a lower end portion of a W shape in an exemplary embodiment of this disclosure.
Figure 17C:
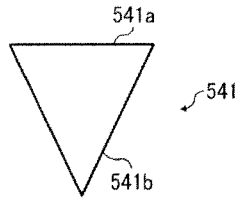
FIG. 17C is a front view of a scraper generally having a V shape in an exemplary embodiment of this disclosure.
Figure 17D:
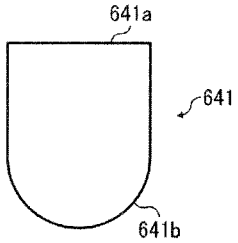
FIG. 17D is a front view of a scraper having a lower end portion of a semicircular shape in an exemplary embodiment of this disclosure.
Figure 17E:
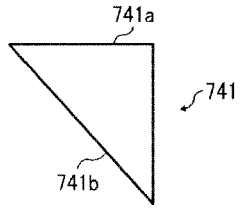
FIG. 17E is a front view of a scraper generally having a triangular shape with two vertexes placed at its right side in an exemplary embodiment of this disclosure.

Alternatively, for example, the width of the upper edge portion may be equal to the width of the lower edge portion. For example, as illustrated in FIG. 17A, a scraper 341 may be formed in a generally home-base shape. As illustrated in FIG. 17B, a scraper 441 may be provided with a W-shaped lower edge portion 441*b*. As illustrated in FIG. 17C, a scraper 541 may be formed in a generally V shape. Alternatively, as illustrated in FIG. 17D, a scraper 641 may be provided with a semicircular lower edge portion 641*b*. As illustrated in FIG. 17E, a scraper 741 may have a triangular shape with two vertexes placed at the left or right side. In the scrapers 341 to 741, the widths of upper edge portions 341*a*, 441*a*, 541*a*, 641*a*, and 741*a* are greater than those of a lower edge portion 341*b*, the lower edge portion 441*b*, a lower edge portion 541*b*, the lower edge portion 641*b*, and a lower edge portion 741*b*, respectively.

In those cases, the lower edge portions 341*b*, 342*b*, 441*b*, 442*b*, 541*b*, 542*b*, 641*b*, 642*b*, 74 1*b*, and 742*b* are oriented downward so as to collect much ink to a narrow end(s), thus facilitating dropping of ink. As a result, as compared with the configuration in which the lower edge portion 241*b* has a horizontally linear shape, such a configuration further facilitates dropping of ink, thus preventing accumulation of ink.

As described above, for the inkjet recording apparatus 201 according to this exemplary embodiment, every time dummy ejection is performed, the inkjet head 4 is moved to the same position relative to the ink receiving belt 210. However, it is to be noted that the position of the inkjet head in dummy ejection is not limited to the above-described position but, for example, when dummy ejection is performed, the position of the inkjet head 4 may be changed as needed.

In other words, typically, an inkjet head uses, for example, 4 to 6 types of different color inks. The viscosity of such color inks is different color by color. As a result, for example, if highly viscous ink is continuously scraped by the same portion of the scraper 241, the highly viscous ink might accumulate at the same portion of the scraper 241, thus hampering smooth ink flow. Hence, in this exemplary embodiment, the position at which the inkjet head 4 performs dummy ejection can be changed as needed, thus preventing highly viscous ink from concentrating on a single point of the scraper 241. Such a configuration can smooth the flow of ink by the scraper 241.

In this regard, through repeated experiments, the inventor of the present application finds that, for example, among black, yellow, cyan, and magenta inks, the black ink is most likely to dry and highest in viscosity. The inventor also finds that cyan ink is least likely to dry and lowest in viscosity. As a result, if different color inks are ejected and left on the ink receiving belt 210, the fluidity of black ink might decrease in a relatively short time, thus resulting in accumulation of black ink. Therefore, it is preferable to mix black ink with other color ink soon after black ink is ejected on the receiving face 210*a* of the ink receiving belt 210. In other words, on the receiving face 210*a*, ink droplets 2 of a color having a lower fluidity are mixed with ink droplets 2 of a color having a higher fluidity.

For example, as illustrated in FIG. 19, the nozzle row 9*k* for black ink may be disposed adjacent to the nozzle row 9*c* for cyan ink in the second head 13. In other words, a nozzle row for ejecting ink droplets of a color having a lower fluidity is disposed adjacent to a nozzle row for ejecting ink droplets of a color having a higher tluidity.

As a result, black ink ejected from the nozzle row 9*k* to the receiving face 210*a* is mixed with cyan ink ejected from the nozzle row 9*c* immediately after ejection. Mixing black ink with cyan ink minimizes a reduction in the tluidity of black ink and facilitates the mixed ink to flow down on the receiving face 210*a*, thus preventing accumulation of ink on the receiving face 210*a*.

Figure 22:
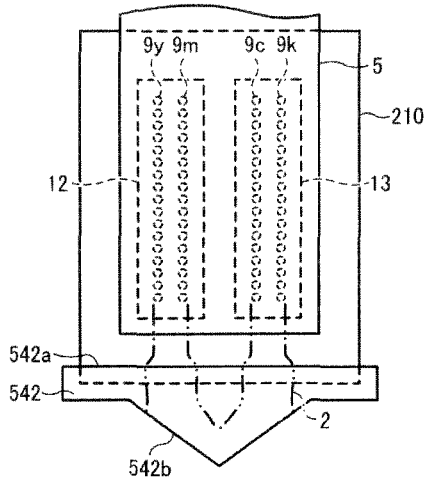
FIG. 22 is a front view of a V-shaped scraper, an ink receiving belt, and ink flow in an exemplary embodiment of this disclosure.

For example, as illustrated in FIG. 22, the nozzle row 9*k* for black ink may be disposed adjacent to the nozzle row 9*c* for cyan ink in the second head 13, and the scraper 542 may have the V-shaped lower edge portion 542*b*. In such a case, four color inks flowing down on the receiving face 210*a* mix one another at a lower end of the lower edge portion 542h. Such a configuration can minimize a reduction in the fluidity of, in particular, black ink and facilitates much ink to concentrate on and drop from a single point, thus preventing accumulation of ink on the receiving face 210*a*.

Figure 23:
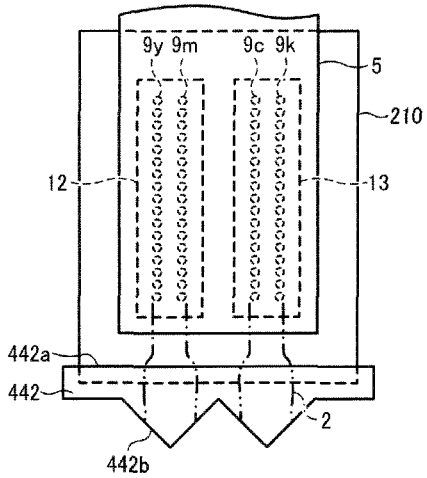
FIG. 23 is a front view of a W-shaped scraper, an ink receiving belt, and ink flow in an exemplary embodiment of this disclosure.

In addition, for example, as illustrated in FIG. 23, the nozzle row 9*k* for black ink may be disposed adjacent to the nozzle row 9*c* for cyan ink in the second head 13, and the scraper 442 may have the W-shaped lower edge portion 442*b*. In such a case, mixing black ink with cyan ink minimizes a reduction in the fluidity of black ink, thus facilitating the mixed ink to flow down on the receiving face 210*a* and concentrate on and drop from narrow tips of the lower edge portion 442*b*. In addition, since the lower edge portion 442*b* has a W shape, the scraper 442 is shorter in the vertical direction than the scraper 542 having the V-shaped lower edge portion 542*b*. Such a configuration can reduce the component cost and minimize the size of the inkjet recording apparatus 201.

Alternatively, for example, in a configuration in which the nozzle row 9*k* for black ink is not disposed adjacent to the nozzle row 9*c* for cyan ink, immediately after ejection of black ink, the inkjet head 4 may be moved to eject cyan ink so as to overlap cyan ink on black ink. In such a case, mixing black ink with cyan ink minimizes a reduction in the fluidity of black ink.

As described above, for the inkjet recording apparatus 201 according to this exemplary embodiment, the nozzle row 9*k* for black ink is disposed adjacent to the nozzle row 9*c* for cyan ink in the inkjet head 4. However, it is to be noted that the configuration of the inkjet recording apparatus is not limited to the above-described configuration but, for example, nozzle rows for any other combination of colors may be arranged adjacent to each other in the inkjet head. In addition, in the above-described exemplary embodiments, the inkjet head 4 ejects four color inks of black, yellow, cyan, and magenta. However, it is to be noted that the configuration of the inkjet recording apparatus is not limited to the above-described configuration but, for example, any other combination of colors may be used.

As described above, for the inkjet recording apparatus 201 according to this exemplary embodiment, the clearance between each nozzle face of the inkjet head 4 and the ink receiving belt 210 is set to be 2 mm. However, it is to be noted that the clearance is not limited to the above-described amount. For example, the clearance between each nozzle face of the inkjet head 4 and the ink receiving belt 210 is preferably determined so that ink adhered on the ink receiving belt 210 does not contact the inkjet head 4 and ink droplets 2 ejected from the inkjet head 4 do not turn into mist.

For example, when the thickness of ink adhered on the ink receiving belt 210 is approximately 0.5 mm, the clearance between each nozzle face of the inkjet head 4 and the ink receiving belt 210 is preferably set to be 1.5 mm or greater so that ink adhered on the ink receiving belt 210 does not contact the inkjet head 4. In addition, the clearance between each nozzle face of the inkjet head 4 and the ink receiving belt 210 is preferably set to be 2 mm or less so that ink droplets 2 ejected from the inkjet head 4 do not turn into mist. Since the distance at which mist does not occur varies with, e.g., the density, radius, and/or ejection speed of ink droplets, the clearance may be set to be any other suitable amount.

In addition, as described above, for the inkjet recording apparatus 201 according to this exemplary embodiment, the time length during which the ink receiving belt 210 rotates after dummy ejection is set to be a time length during which ink droplets 2 ejected on the ink receiving belt 210 are fully scraped by the scraper 241. However, it is to be noted that the configuration of the inkjet recording apparatus is not limited to the above-described configuration but, for example, the ink receiving belt 210 may be made one rotation after dummy ejection. Alternatively, for example, the second gear 232 may be integrally formed with the driving roller shaft 221 so that the ink receiving belt 210 constantly rotates during conveyance of the recording medium 3.

In addition, as described above, for the inkjet recording apparatus 201 according to this exemplary embodiment, each time dummy ejection is finished (at S1), the controller rotates the ink receiving belt 210 to scrape ink from the ink receiving belt 210. However, it is to be noted that the operation of the inkjet recording apparatus is not limited to the above-described operation but, for example, when dummy ejection ends, the controller may count up a counter and, when the counter goes beyond a threshold number of times, rotate the ink receiving belt 210 to remove ink from the ink receiving belt 210. Such operation can minimize the number of times of ink scraping operation, thus extending the product life of the scraper 241, the ink receiving belt 210 and so on.

As described above, for the inkjet recording apparatus 201 according to this exemplary embodiment, the outer surface side of the ink receiving belt 210 is water repellent. However, it is to be noted that the configuration of the inkjet recording apparatus is not limited to the above-described configuration but, for example, the outer surface side of the ink receiving belt 210 may be hydrophilically coated. For example, a coating material of Teflon (registered trademark) resin or a hydrophilically coating material of titanium dioxide or fiber glass (film) may be used to form hydrophilic coating. In such a case, ink adhered on the outer surface side of the ink receiving belt 210 turns into a liquid film without forming droplets, thus preventing ink from remaining adhering in droplet form and hardening on the outer surface side of the ink receiving belt 210.

As described above, for the inkjet recording apparatus 201 according to this exemplary embodiment, the outer surface of the scraper 24) is water repellent. However, it is to be noted that the configuration of the inkjet recording apparatus is not limited to the above-described configuration but, for example, the outer surface of the scraper 241 may be hydrophilically coated. For example, a coating material of Teflon (registered trademark) resin or a hydrophilically coating material of titanium dioxide or fiber glass (film) may be used to form hydrophilic coating. In such a case, ink adhered on the outer surface of the scraper 241 turns into a liquid film without forming droplets, thus preventing ink from remaining adhering in droplet form and hardening on the outer surface of the scraper 241.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An inkjet recording apparatus comprising:

an inkjet head to horizontally eject ink droplets to print on a recording medium; and an ink receiving assembly to receive ink droplets ejected for dummy ejection from the inkjet head, the ink receiving assembly comprising:

a non-porous ink receiving plate having a hydrophilic receiving face broader than an ejection range of the ink droplets ejected for dummy ejection, the receiving face substantially vertically disposed to receive the ink droplets ejected for dummy ejection, a collection tank disposed below the ink receiving plate to collect ink droplets received by and dropped from the ink receiving plate, and a cleaning device to clean the receiving face of the ink receiving plate the cleaning device comprising:

a wiper swingable between an original position and a turnaround position to wipe ink droplets adhering on the receiving face of the ink receiving plate for cleaning, an engagement member integrally provided with the wiper to engage an end face of the inkjet head in a moving direction of the inkjet head, and an urging member to urge the wiper in a direction to return the wiper to the original position, when the inkjet head is placed away from in front of the ink receiving plate and disengaged from the engagement member, the wiper is placed at the original position by an urging force of the urging member, when the inkjet head is placed in front of the ink receiving plate and contacts the engagement member, the wiper is placed at the turnaround position against the urging force of the urging member, with movement of the inkjet head, the wiper swings between the original position and the turnaround position to clean the receiving face;

wherein a distance between the inkjet bead and the receiving face of the ink receiving plate is set to be shorter than a distance in which the ink droplets ejected from the inkjet head for dummy ejection turn into mist.

2. The inkjet recording apparatus of claim 1, wherein the receiving face is a slanted face having an upper portion proximal to the inkjet head and a lower portion distal to the inkjet head.

3. The inkjet recording apparatus of claim 1, wherein the receiving face is flat.

4. The inkjet recording apparatus of claim 1, wherein the receiving face is curved.

5. The inkjet recording apparatus of claim 1, wherein the ink receiving plate is removably mountable relative to the ink receiving assembly.

6. The inkjet recording apparatus of claim 1. wherein the receiving face is configured to mix ink droplets of a color of higher fluidity with ink droplets of a color of lower fluidity.

7. The inkjet recording apparatus of claim 6, wherein the inkjet head has a nozzle row to eject the ink droplets of the color of higher fluidity and a nozzle row to eject the ink droplets of the color of lower fluidity that are arranged adjacent to each other.

8. The inkjet recording apparatus of claim 1, wherein the collection tank is movably disposed.

9. An inkjet recording apparatus comprising:

an inkjet head to horizontally eject ink droplets to print on a recording medium; and an ink receiving assembly to receive ink droplets ejected for dummy ejection from the inkjet head outside a printing area of the inkjet head, the ink receiving assembly comprising a porous ink receiving belt having a receiving face broader than an ejection range of the ink droplets ejected for dummy ejection, the receiving face substantially vertically disposed opposing the inkjet head to receive the ink droplets ejected for dummy ejection and disposed away from the inkjet head in a distance shorter than a distance in which the ink droplets ejected from the inkjet head for dummy ejection turn into mist, a support device to rotatably support the ink receiving belt, a rotary device to rotate the ink receiving belt toward a lower side of the receiving face, a scraping device disposed below the receiving face to scrape ink droplets adhering on the receiving face with movement of the receiving face, and a collection tank disposed below the scraping device to collect ink scraped from the receiving face by the scraping device.

10. The inkjet recording apparatus of claim 9, further comprising a conveyance assembly to convey the recording medium, wherein the rotary device is connected to and driven by the conveyance assembly.

11. The inkjet recording apparatus of claim 9, wherein, after the inkjet head ejects the ink droplets for dummy ejection, the rotary device rotates the ink receiving belt by such an amount that the ink droplets adhering on the receiving face are fully scraped by the scraping device.

12. The inkjet recording apparatus of claim 9, wherein the scraping device has an upper edge portion to contact the receiving face and scrape the ink droplets adhering on the receiving Ike and a scraping face continuously formed with the upper edge portion to flow the ink droplets scraped by the upper edge portion, and the scraping face forms an acute angle relative to the receiving face.

13. The inkjet recording apparatus of claim 9, wherein the ink receiving belt has an opposing portion of the ink receiving belt opposing the inkjet head and a bent portion bent by the rotary device below the opposing portion, the upper edge portion of the scraping device is disposed in contact with the bent portion, and the scraping face of the scraping device is tilted downward.

14. The inkjet recording apparatus of claim 9, wherein the ink droplets ejected for dummy ejection from the inkjet head are of a plurality of different colors and the scraping device has a lower edge portion of a V shape.

15. The inkjet recording apparatus of claim 9, wherein the receiving face is configured to mix ink droplets of a color of higher fluidity with ink droplets of a color of lower fluidity.

16. The inkjet recording apparatus of claim 15, wherein the inkjet head has a nozzle row to eject the ink droplets of the color of higher fluidity and a nozzle row to eject the ink droplets of the color of lower fluidity that are arranged adjacent to each other.

17. The inkjet recording apparatus of claim 9, wherein the collection tank is movable.

* * * * *